US009528318B2

(12) United States Patent
Huang et al.

(10) Patent No.: US 9,528,318 B2
(45) Date of Patent: Dec. 27, 2016

(54) WINDOW SHADE AND ACTUATING SYSTEM THEREOF

(71) Applicant: TEH YOR CO., LTD., Taipei (TW)

(72) Inventors: Chin-Tien Huang, New Taipei (TW); Fu-Lai Yu, New Taipei (TW)

(73) Assignee: Teh Yor Co., Ltd. (TW)

( * ) Notice: Subject to any disclaimer, the term of this patent is extended or adjusted under 35 U.S.C. 154(b) by 21 days.

(21) Appl. No.: 14/733,499

(22) Filed: Jun. 8, 2015

(65) Prior Publication Data

US 2015/0376944 A1 Dec. 31, 2015

Related U.S. Application Data

(60) Provisional application No. 62/009,402, filed on Jun. 9, 2014.

(51) Int. Cl.

| | |
|---|---|
| ***E06B 9/262*** | (2006.01) |
| ***E06B 9/68*** | (2006.01) |
| ***E06B 9/322*** | (2006.01) |

(52) U.S. Cl.

CPC ..... *E06B 9/68* (2013.01); *E06B 9/262* (2013.01); *E06B 9/322* (2013.01); *E06B 2009/2627* (2013.01); *E06B 2009/3222* (2013.01)

(58) Field of Classification Search

CPC ..... E06B 2009/2627; E06B 2009/3222; E06B 2009/3225; E06B 2009/3227

USPC ..... 160/84.05, 84.02, 170, 171

See application file for complete search history.

(56) References Cited

U.S. PATENT DOCUMENTS

| | | | | |
|---|---|---|---|---|
| 4,498,517 | A * | 2/1985 | Mase | E06B 9/82 160/294 |
| 6,529,323 | B2 * | 3/2003 | Okumura | E06B 9/42 160/297 |
| 7,624,785 | B2 * | 12/2009 | Yu | E06B 9/322 160/171 |
| 8,191,605 | B2 * | 6/2012 | Kwak | E06B 9/42 160/193 |
| 8,356,653 | B2 * | 1/2013 | Fu-Lai | E06B 9/322 160/170 |
| 8,746,320 | B2 * | 6/2014 | Yu | E06B 9/322 160/170 |
| 9,062,492 | B2 * | 6/2015 | Yu | E06B 9/322 |
| 9,187,951 | B2 * | 11/2015 | Yu | E06B 9/322 |
| 2013/0220561 | A1 | 8/2013 | Yu et al. | |
| 2013/0340951 | A1 | 12/2013 | Yu et al. | |

FOREIGN PATENT DOCUMENTS

| | | |
|---|---|---|
| CN | 203383711 U | 1/2014 |

OTHER PUBLICATIONS

Office Action issued on Jul. 21, 2016 in corresponding TW Patent Application No. 104118534.

* cited by examiner

*Primary Examiner* — David Purol

(74) *Attorney, Agent, or Firm* — Baker & McKenzie LLP; David I. Roche

(57) ABSTRACT

The structures described herein use an actuating system that can selectively switch between a lower and a raise mode of operation by rotating a rod assembly, and use a downward displacement of a pull member to lower and raise the window shade depending on whether its switching state. The actuating systems are simple to operate, allow convenient adjustment of the window shade, and are safe as the pull member has a limited length of extension.

21 Claims, 24 Drawing Sheets

WINDOW SHADE AND ACTUATING SYSTEM THEREOF

CROSS-REFERENCE TO RELATED APPLICATION(S)

This application claims priority to U.S. Provisional Patent Application No. 62/009,402 filed on Jun. 9, 2014, which is incorporated herein by reference.

BACKGROUND

1. Field of the Invention

The present invention relates to window shades, and actuating systems used in window shades.

2. Description of the Related Art

Many types of window shades are currently available on the market, such as Venetian blinds, roller shades and honeycomb shades. The shade when lowered can cover the area of the window frame, which can reduce the amount of light entering the room through the window and provided increased privacy. Conventionally, the window shade is provided with an operating cord that can be actuated to raise or lower the window shade. In particular, the operating cord may be pulled downward to raise the window shade, and released to lower the window shade.

In a conventional construction of the window shade, the operating cord can be connected with a drive axle. When the operating cord is pulled downward, the drive axle can rotate to wind suspension cords for raising the window shade. When the operating cord is released, the drive axle can be driven to rotate in a reverse direction for lowering the window shade.

However, this conventional construction may require to use an increased length of the operating cord for window shades that have greater vertical lengths. The greater length of the operating cord may affect the outer appearance of the window shade. Moreover, there is the risk of child strangle on the longer operating cord. To reduce the risk of accidental injuries, the operating cord may be maintained at a higher position so that a young child cannot easily reach the operating cord. Unfortunately, when the operating cord is pulled downward to raise the window shade, the operating cord may still move to a lower position and become accessible for a child. With respect to a regular user, the manipulation of longer operating cords may also be less convenient. For example, the longer operating cord may become entangled, which may render its operation difficult.

To remedy the above disadvantages, certain existing approaches propose a mechanism that can be actuated by repeated pulling actions applied on a cord for raising the window shade. However, these approaches usually need a manual action different from the pulling action for lowering the window shade.

Therefore, there is a need for a window shade that is simple to operate, and address or improve at least the foregoing issues.

SUMMARY

The present application describes a window shade and an actuating system for use with the window shade.

In one embodiment, the actuating system includes a transmission axle rotatable to collapse and expand a window shade, and a driving unit including a shaft portion and a pull member, the pull member being operable to drive rotation of the shaft portion in a first direction. The actuating system further includes a first central gear, a plurality of first planetary gears respectively meshed with the first central gear, a second central gear rotationally coupled with the transmission axle, a plurality of second planetary gears respectively meshed with the second central gear and the first planetary gears, and a switch member rotationally coupled with the shaft portion. The switch member is further movable along an axis of the shaft portion between a first position where the switch member and the first central gear are coupled with each other for rotation in the first direction, and a second position where the switch member and the second central gear are coupled with each other for rotation in the first direction. A rotation of the shaft portion in the first direction drives rotation of the transmission axle in a second direction opposite to the first direction when the switch member is in the first position, and drives rotation of the transmission axle in the first direction when the switch member is in the second position.

Moreover, the present application describes a window shade that includes a head rail, a bottom part, a shading structure arranged vertically between the head rail and the bottom rail, a winding unit having a suspension member connected with the bottom part, and the actuating system arranged in the head rail. The winding unit is rotationally coupled with the transmission axle, wherein the transmission axle rotates in the second direction to cause unwinding of the suspension member from the winding unit for lowering the bottom part, and in the first direction to wind the suspension member into the winding unit for raising the bottom part.

DETAILED DESCRIPTION OF THE EMBODIMENTS

Figure 1:
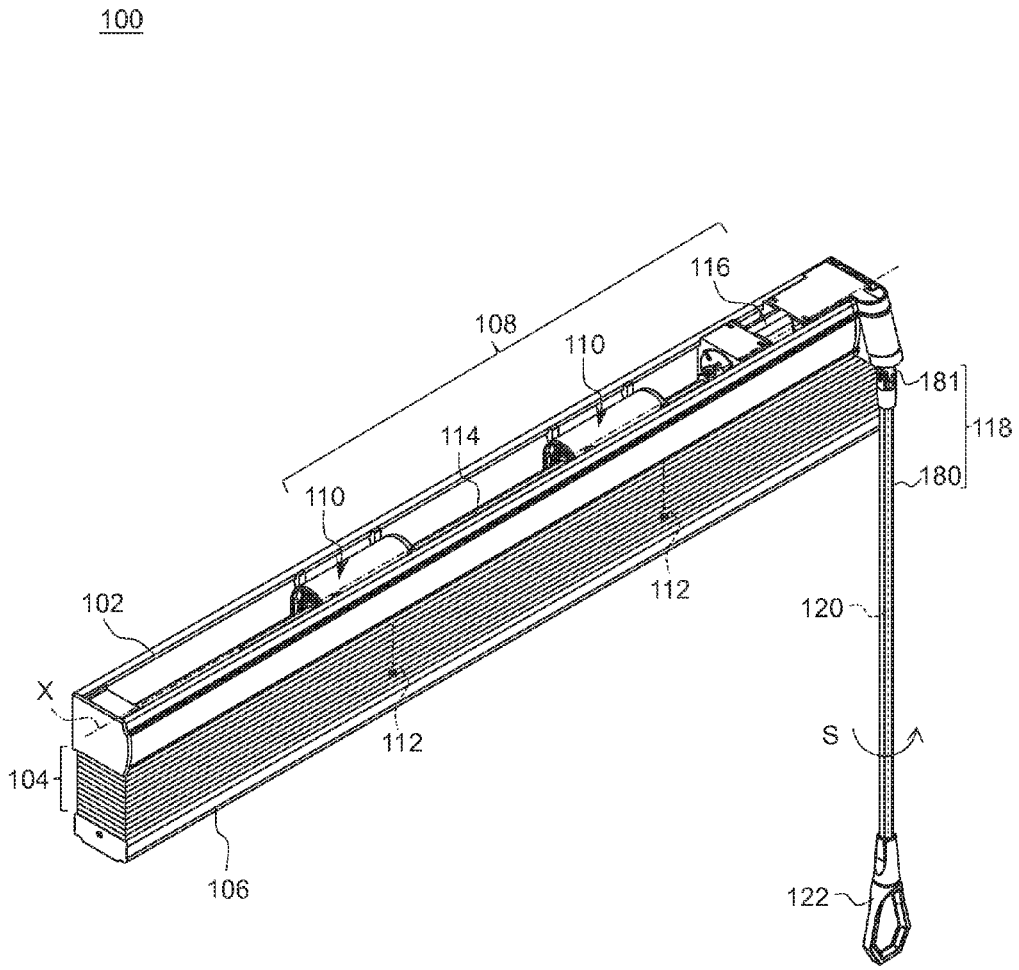
FIG. 1 is a perspective view illustrating an embodiment of a window shade.
Figure 2:
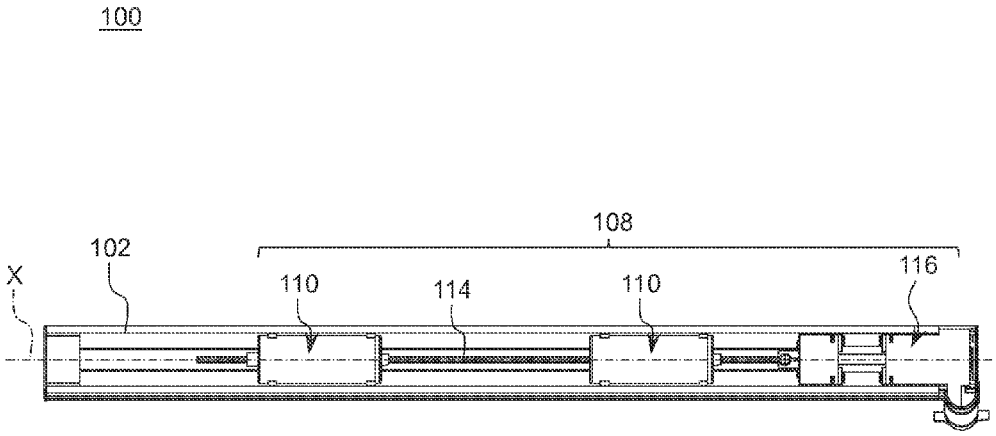
FIG. 2 is top view of the window shade shown in FIG. 1.
Figure 3:
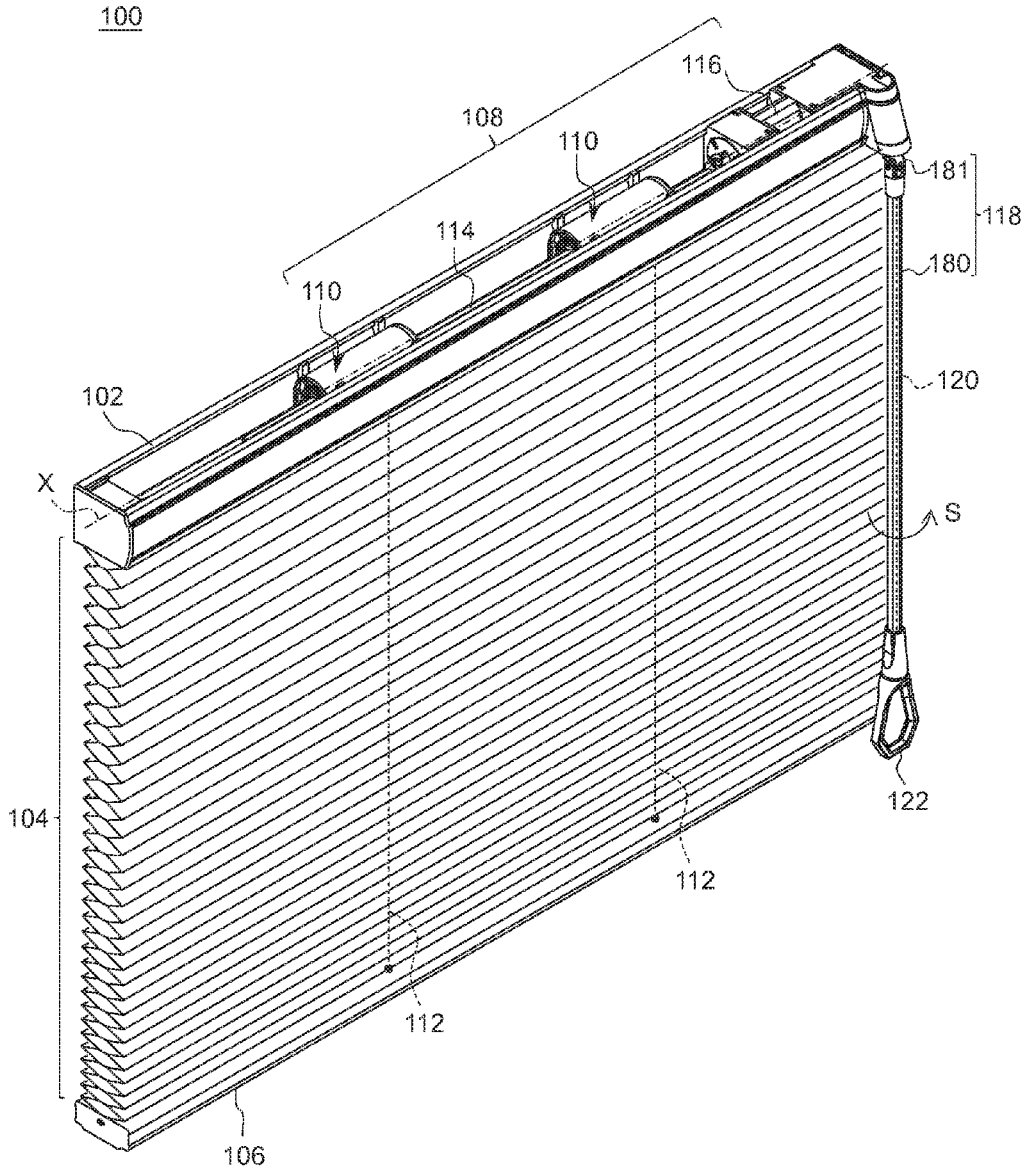
FIG. 3 is a schematic view illustrating the window shade of FIG. 1 in a lowered state.

FIG. 1 is a perspective view illustrating an embodiment of a window shade 100, FIG. 2 is a top view illustrating the window shade 100, and FIG. 3 is a schematic view illustrating the window shade 100 in a lowered state. The window shade 100 can includes a head rail 102, a shading structure 104, and a bottom part 106 disposed at a bottom of the shading structure 104. The head rail 102 may be of any types and shapes. The head rail 102 may be affixed at a top of a window frame, and the shading structure 104 and the bottom part 106 can be suspended from the head rail 102.

The shading structure 104 can have any suitable constructions. For example, the shading structure 104 can include a honeycomb structure made from a cloth material (as shown), a Venetian blind construction, or a plurality of rails or slats extending vertically and parallel to one another.

The bottom part 106 is disposed at a bottom of the window shade 100, and is movable vertically relative to the head rail 102 to expand and collapse the shading structure 104. In one embodiment, the bottom part 106 may be formed as an elongated rail. However, any types of weighing structures may be suitable. In some embodiment, the bottom part 106 may also be formed by a lowermost portion of the shading structure 104.

For driving upward and downward displacements of the shading structure 104 and the bottom part 106, the window shade 100 can further include an actuating system 108 comprised of a plurality of winding units 110, a plurality of suspension members 112 (shown with phantom lines in FIG. 1) respectively coupled with the winding units 110, a transmission axle 114, a control module 116, a rod assembly 118 and a pull member 120 (shown with phantom lines in FIG. 1). The suspension members 112 can exemplary be suspension cords that extend vertically between the head rail 102 and the bottom part 106. Each of the suspension members 112 can have a first end portion connected with one corresponding winding unit 110, and a second end portion connected with the bottom part 106. The winding units 110 can respectively have drums rotatable to wind and unwind the suspension members 112 for raising and lowering the bottom part 106.

The transmission axle 114 can extend lengthwise along the head rail 102 to define a longitudinal axis X, and the winding units 110 and the control module 116 and can be coaxially connected with the transmission axle 114. The transmission axle 114 can be actuated through the control module 116 to rotate in either direction, which in turn drives concurrent rotation of the winding units 110 for winding or unwinding the suspension members 112.

In the illustrated embodiment, the pull member 120 can exemplary be a cord. The pull member 120 is connected with the control module 116, and can be pulled downward to drive rotation of the transmission axle 114 in either direction. A handle 122 can be connected with a lower end of the pull member 120 to facilitate its operation. The pull member 120 has a length that is substantially smaller than the height of the totally expanded shading structure 104, and the control module 116 is configured such that a user repeatedly applies a sequence of pull and release actions on the pull member 120 to progressively lower or raise the bottom part 106. For example, the overall length of the pull member 120 can be one third of the height of the totally expanded shading structure 104, and the pull member 120 can be repeatedly pulled about three times to entirely lower the shading structure 104. This process is similar to a ratcheting technique allowing the user to pull the pull member 120 to lower or raise the bottom part 106 by a certain amount, allow the pull member 120 to retract, and then actuate the pull member 120 again to continue to lower or raise the bottom part 106. This process may be repeated until the shading structure 104 reaches a desired height.

The control module 116 can be switched by rotating the rod assembly 118 in a direction S to select any of two driving modes of operation for the operating cord 120: a raise or upward driving mode where the pull member 120 is pulled downward to drive an upward displacement the bottom part 106, and a lower or downward driving mode where the pull member 120 is pulled downward to drive a downward displacement of the bottom part 106. When the pull member 120 is not operated, the suspended weight of the shading structure 104 and the bottom part 106 can be sustained by an arrester, which may also be incorporated in the control module 116.

Figure 4:
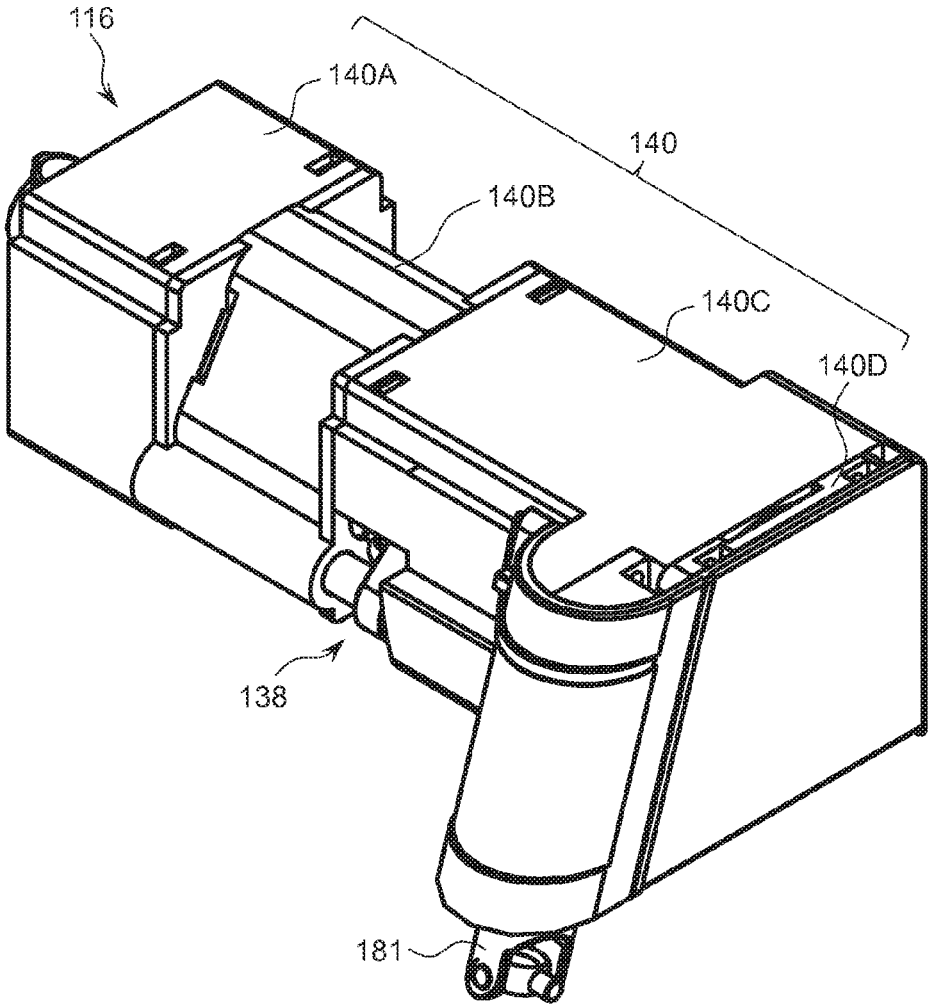
FIG. 4 is a schematic view illustrating a control module used in an actuating system of the window shade shown in FIG. 1.
Figure 5:
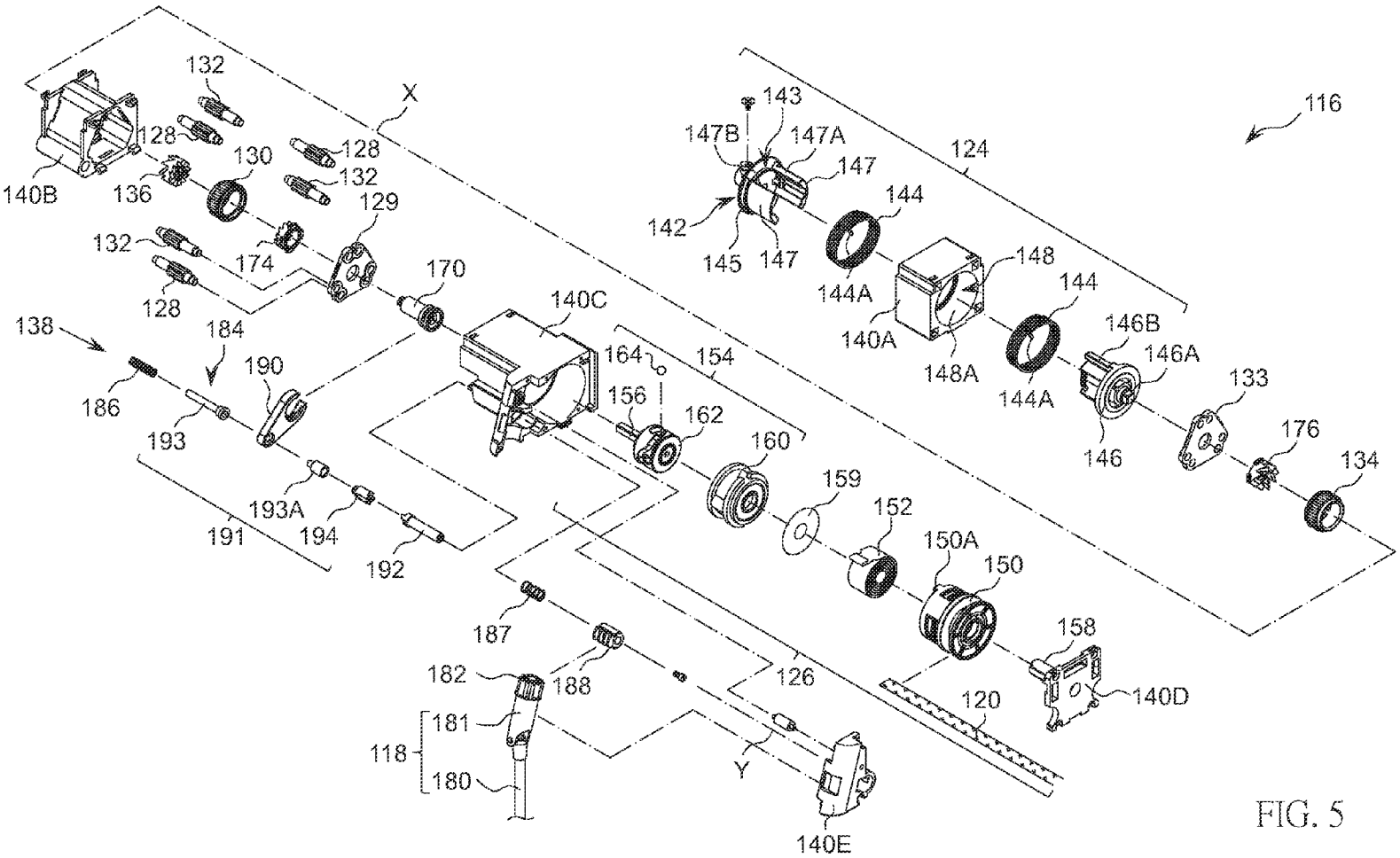
FIG. 5 is an exploded view illustrating an actuating mechanism implemented in the control module shown in FIG. 4.
Figure 6:
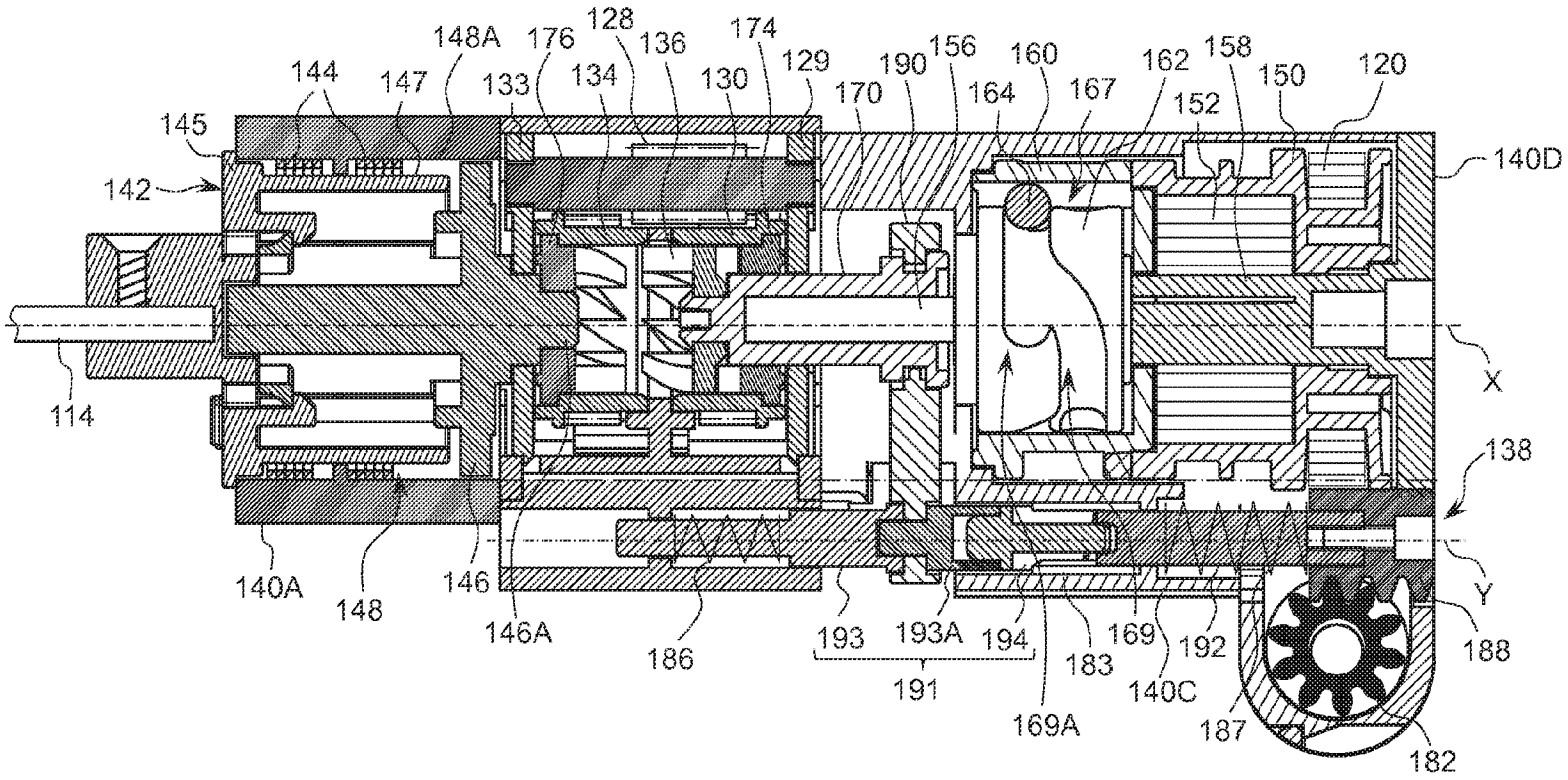
FIG. 6 is a cross-sectional view illustrating the control module shown in FIG. 4.

FIG. 4 is a schematic view of the control module 116, FIG. 5 is an exploded view illustrating an actuating mechanism implemented in the control module 116, and FIG. 6 is a cross-sectional view illustrating the control module 116. The control module 116 can include an arrester 124, a driving unit 126, a first set of gears comprised of a plurality of planetary gears 128 that are pivotally supported by a fixed carrier 129 and are respectively meshed with a central gear 130, a second set of gears comprised of a plurality of planetary gears 132 that are pivotally supported by a fixed carrier 133 and are respectively meshed with another central gear 134, a switch member 136 and a switch actuating mechanism 138. These components of the control module 116 can be arranged in a casing 140 formed by the assembly of multiple housing portions 140A, 140B, 140C and 140E, and an end cap 140D affixed with one another.

The arrester 124 can include a collar 142, one or more spring 144 (two springs 144 are exemplary shown) and an actuating part 146. The collar 142 can be attached with the transmission axle 114 for unitary rotation therewith. In one embodiment, the collar 142 can have an annular portion 145, and two spaced-apart flanges 147 that respectively project from the annular portion 145. The two flanges 147 can respectively define two flange surfaces 147A and 147B that are offset from the axis of the transmission axle 114 and delimit two opposite sides of a gap 143.

Figure 7:
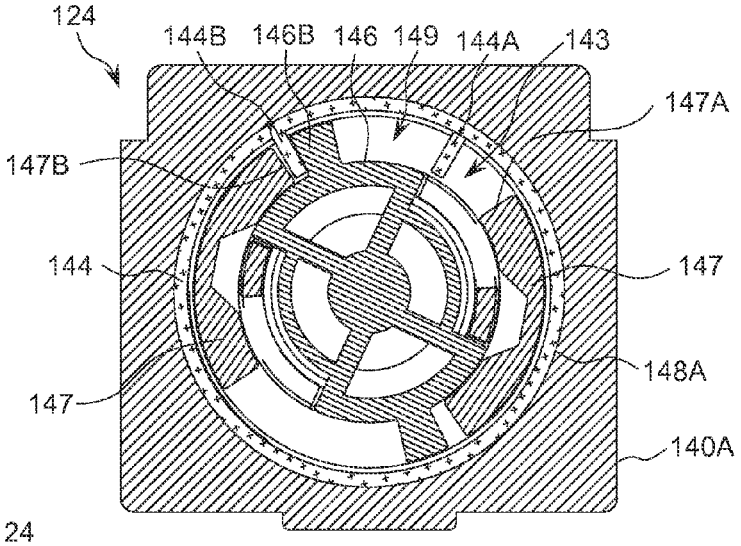
FIG. 7 is a schematic view illustrating an arrester of the actuating system in a locking state.
Figure 8:
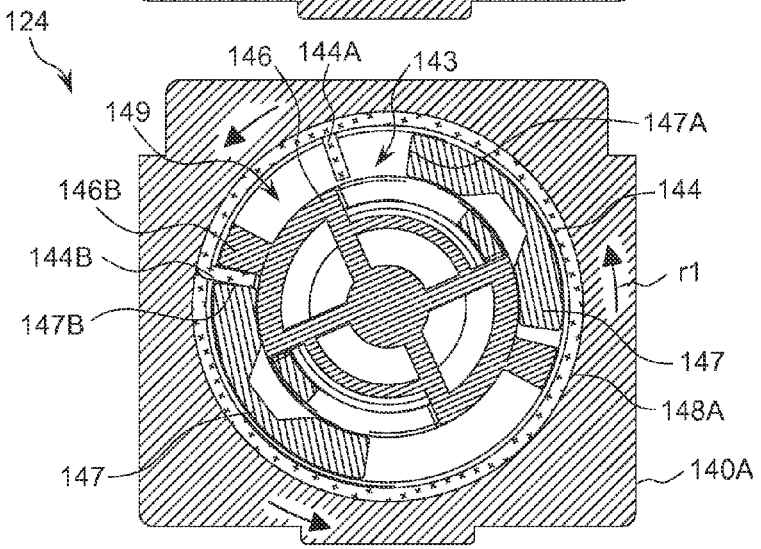
FIG. 8 is a schematic view illustrating the arrester of the actuating system turned to a release state for raising a bottom part of the window shade.
Figure 9:
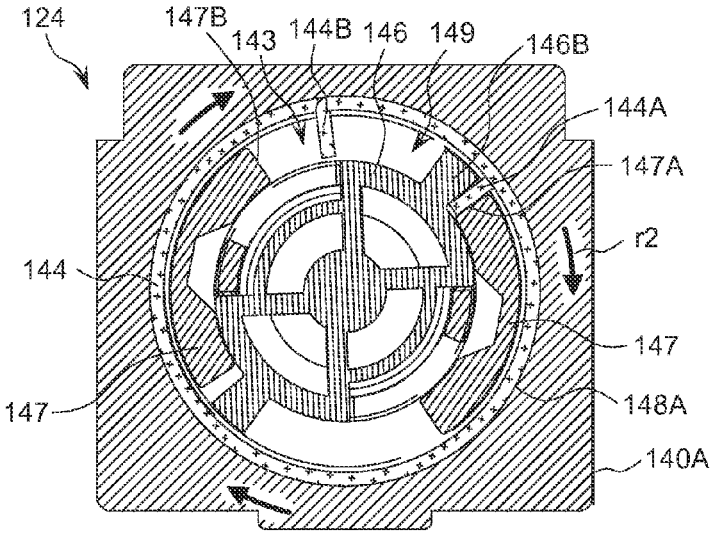
FIG. 9 is a schematic view illustrating the arrester of the actuating system turned to a release state for lowering a bottom part of the window shade.
Figure 10:
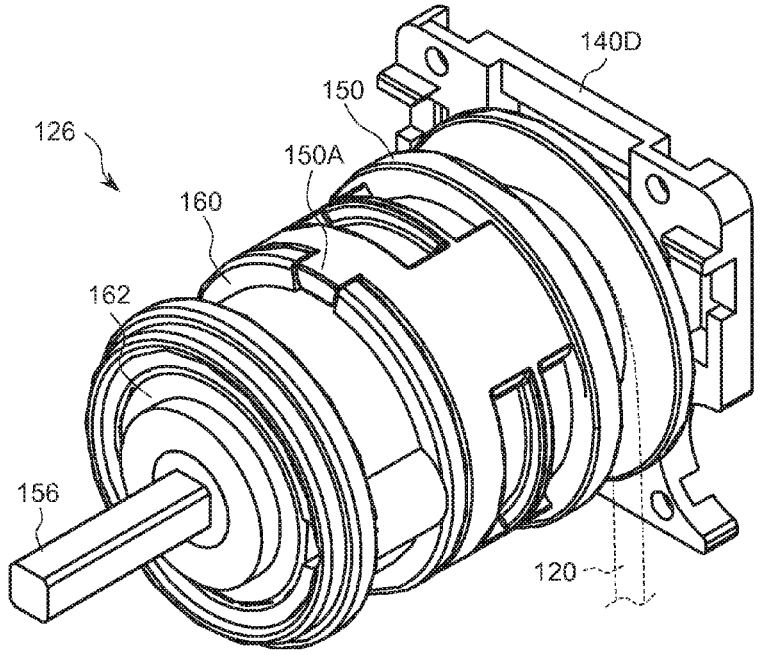
FIG. 10 is a perspective view illustrating a construction of a driving unit incorporated in the control module shown in FIG. 4.

Each of the springs 144 can be a coil spring having two spaced-apart prongs 144A and 144B (better shown in FIGS. 7-9). The springs 144 are assembled in a cavity 148 of the casing 140 coaxial to the axis of the transmission axle 114, and have respective outer circumferences in contact with an inner sidewall 148A of the cavity 148. The cavity 148 can be provided, e.g., in the housing portion 140A. Moreover, the springs 144 are positioned to encircle the flanges 147 of the collar 142, and the prongs 144A and 144B can be respectively received in the gap 143 between the two flange surfaces 147A and 147B. In other words, the two flange surfaces 147A and 147B are located outside a space 149 (better shown in FIGS. 7-9) delimited between the two prongs 144A and 144B.

The actuating part 146 can include a shaft portion 146A, and a rib 146B eccentric from the axis of the shaft portion 146A. The actuating part 146 can be pivotally assembled coaxial to the axis of the transmission axle 114, the shaft portion 146A being aligned with the transmission axle 114, and the rib 146B being received in the space 149 between the two prongs 144A and 144B of each spring 144. An end portion of the actuating part 146 opposite to the side of the shaft portion 146A can be attached with the transmission axle 114 through a connection that rotationally couples the actuating part 146 with the transmission axle 114 (e.g., the actuating part 146 may be affixed with the collar 142). The actuating part 146 and the transmission axle 114 thus can rotate in unison in two directions to unlock the arrester 124 and either raise or lower the bottom part 106.

In conjunction with FIGS. 4-6, FIGS. 7-9 are schematic views illustrating exemplary operation of the arrester 124. In FIG. 7, the arrester 124 is exemplary illustrated in a locking state, and no manual pulling action is applied on the pull member 120. In this state, a vertical weight exerted by the bottom part 106 on the suspension members 112 can result in the application of a torque that rotationally biases the collar 142 in a direction to urge one of the two flange surfaces 147A and 147B (e.g., the flange surface 147B) against one of the two prongs 144A and 144B (e.g., the prong 144B). This pushing force is in a direction that biases the prongs 144A and 144B toward each other (i.e., in a direction narrowing the space 149), which urges the springs 144 to enlarge and frictionally contact with the inner sidewall 148A of the cavity 148. The frictional contact between the outer circumference of each spring 144 with the inner sidewall 148A can counteract the torque induced by the suspended weight, and prevent rotation of the springs 144, the collar 142 and the transmission axle 114 affixed with the collar 142 in a direction of lowering the bottom part 106. The bottom part 106 can be thereby kept stationary at a desired height.

For turning the arrester 124 from the locking state to a release state, the actuating part 146 can be driven in rotation so as to cause the rib 146B to push against either of the two prongs 144A and 144B (i.e., in a direction for enlarging the space 149), which causes the springs 144 to contract and loosen the frictional contact with the inner sidewall 148A of the cavity 148. The contracted springs 144 then can be urged in rotation by the rib 146B of the actuating part 146, and either of the two prongs 144A and 144B can in turn push against either of the flange surfaces 147A and 147B of the collar 142 to drive rotation of the collar 142 and transmission axle 114 for raising or lowering the bottom part 106.

Referring to FIG. 8, when the actuating part 146 exemplary rotates in a direction r1 for raising the bottom part 106, the rib 146B can exemplary push against the prong 144B to contract each spring 144 and urge rotation of the spring 144 in the same direction. As the contracted springs 144 rotate with the actuating part 146, the prongs 144B of the springs 144 can in turn push against the flange surface 147B of the collar 142, which causes rotation of the collar 142 and the transmission axle 114 in the same direction r1 to raise the bottom part 106.

Referring to FIG. 9, when the actuating part 146 rotates in a direction r2 opposite to r1 for lowering the bottom part 106, the rib 146B can push against the prong 144A to contract each spring 144 and urge rotation of the spring 144 in the same direction. As the contracted springs 144 rotate with the actuating part 146, the prongs 144A of the springs 144 can then push against the flange surface 147A of the collar 142, which causes rotation of the collar 142 and the transmission axle 114 in the same direction r2 to lower the bottom part 106.

In conjunction with FIGS. 4-6, FIGS. 10 and 11 are respectively perspective and exploded views illustrating a construction of the driving unit 126. Referring to FIGS. 4-6, 10 and 11, the driving unit 126 can include the pull member 120 (shown with phantom lines) described previously, a spool 150 to which the pull member 120 is connected, a spring 152, a unidirectional coupling device 154 and a shaft portion 156. The spool 150 can be pivotally connected with a fixed shaft 158 that is fixedly connected with the end cap 140D. The fixed shaft 158 can be coaxial to the transmission axle 114, and can define the pivot axis of the spool 150. A tab 150A may be provided on the spool 150 at a location radially offset from its pivot axis. The spool 150 can be affixed with an end of the pull member 120, which can extend outside the casing 140 of the control module 116.

The spring 152 can be a spiral torsion spring arranged in an inner cavity of the spool 150, and can have an inner end connected with the fixed axle 158 and an outer end connected with the spool 150. A washer 159 (better shown in FIG. 5) can be assembled about the fixed shaft 158 to retain the spring 152 in the interior of the spool 150. The spring 152 can bias the spool 150 to rotate for winding the pull member 120.

The unidirectional coupling device 154 can include a sleeve 160, a drum 162 and a ball 164. The sleeve 160 can be pivotally connected with the fixed shaft 158 adjacent to the spool 150. The sleeve 160 can have an inner cylindrical sidewall 165 that defines an inner cavity 166 and is formed with a slot 167 extending parallel to the axis of the fixed shaft 158. A periphery of the sleeve 160 can have a notch 168 in which is engaged the tab 150A of the spool 150, whereby the sleeve 160 and the spool 150 can be rotationally coupled with each other in two directions of rotation.

The drum 162 can have an outer surface provided with a closed guide track 169 that circumferentially runs around the drum 162. The drum 162 can be pivotally connected through the inner cavity 166 of the sleeve 160 about an axis that is coaxial to the fixed shaft 158. When the drum 162 is assembled with the sleeve 160, the slot 167 overlaps partially with the guide track 169, and the ball 164 can be movably arranged in the slot 167 and the guide track 169.

The shaft portion 156 is arranged substantially coaxial to the transmission axle 114. The shaft portion 156 can be coaxially affixed with the drum 162, such that the shaft portion 156 and the drum 162 are rotatable in unison about the same axis defined by the fixed shaft 158. The shaft portion 156 can be a separate part affixed with the drum 162, or formed integrally with the drum 162.

Figure 11:
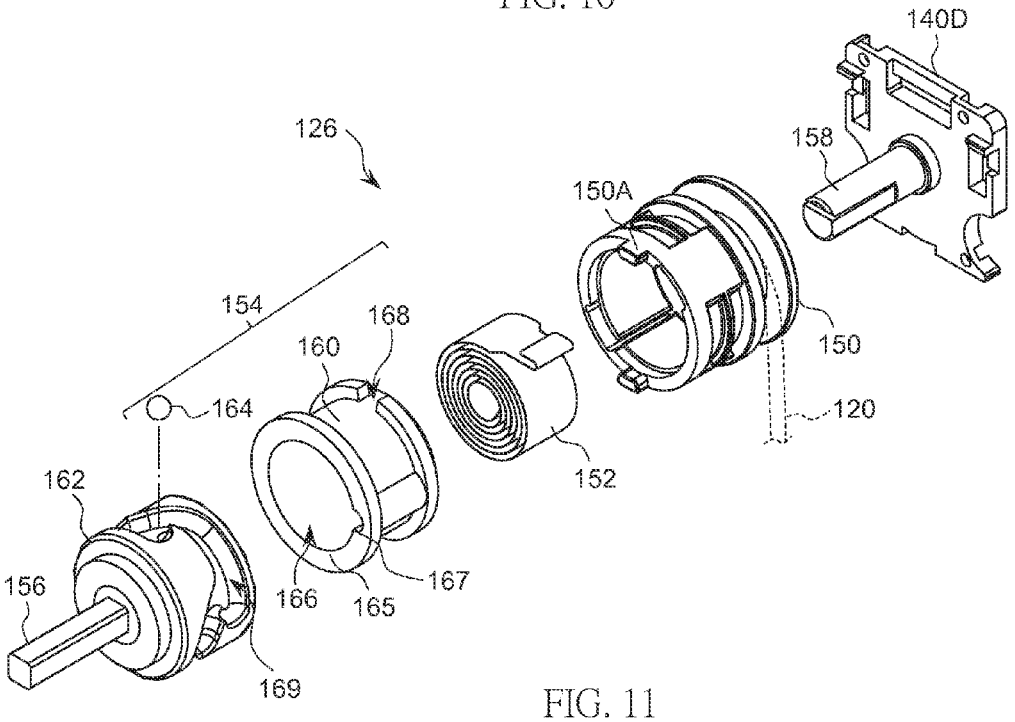
FIG. 11 is an exploded view illustrating the construction of the driving unit shown in FIG. 10.
Figure 12:
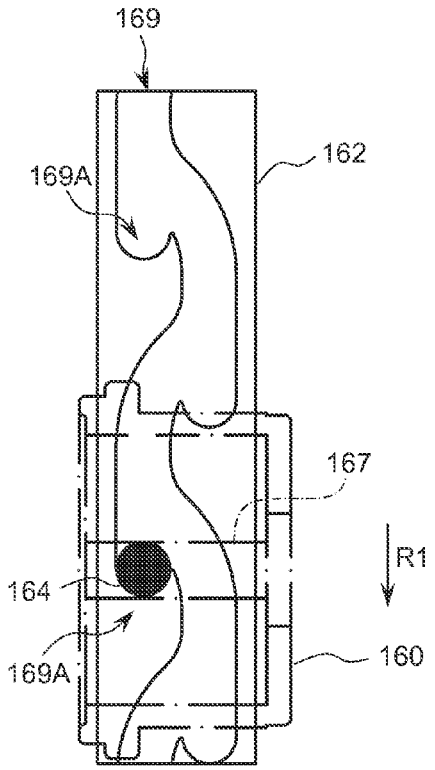
FIGS. 12 and 13 are schematic views illustrating the interaction between a sleeve, a drum and ball in the driving unit shown in FIG. 10.
Figure 13:
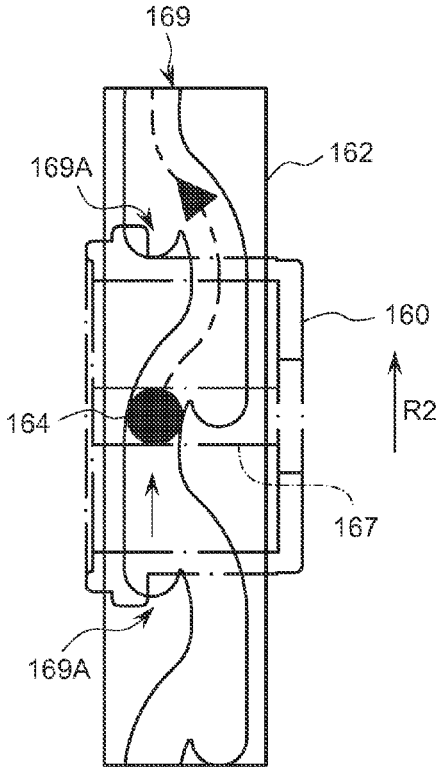
Figure 14:
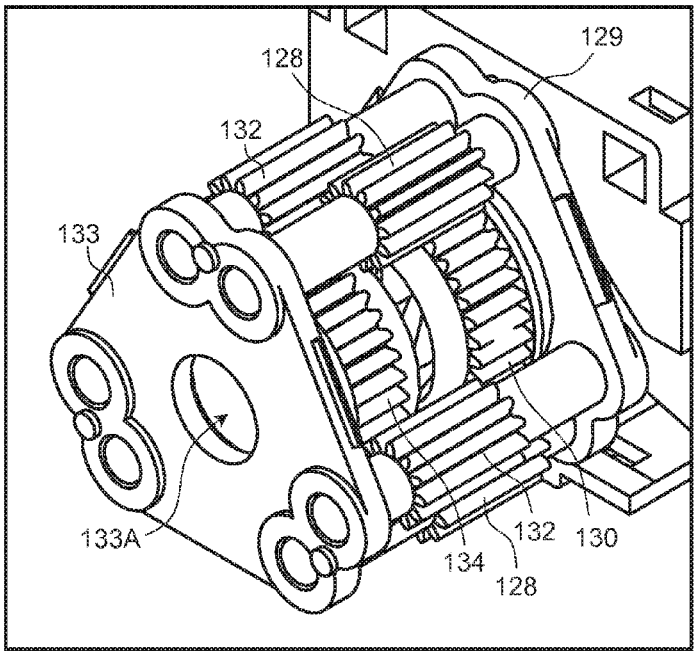
FIG. 14 is a schematic view illustrating the assembly of a drive transmission provided in the control module shown in FIG. 4.

In conjunction with FIG. 11, FIGS. 12 and 13 are schematic views illustrating the interaction between the sleeve 160, the drum 162 and the ball 164. The guide track 169 is represented in a planar projection in FIGS. 12 and 13. The guide track 169 can include a plurality of recessed stop regions 169A distributed around the drum 162. Referring to FIG. 12, when the sleeve 160 and the spool 150 rotate in unison in a first direction R1 for unwinding the pull member 120, the ball 164 can displace along the slot 167 and the guide track 169 until it engages with one of the stop regions 169A, whereby the rotational displacement of the spool 150 can be transmitted through the sleeve 160, the ball 164 and the drum 162 to the shaft portion 156. In other words, a downward pulling action applied on the pull member 120 always drives the spool 150 and the shaft portion 156 to rotate in the same direction R1.

Referring to FIG. 13, when the pull member 120 is released after it is extended downward, the spring 152 can urge the spool 150 to rotate in a second direction R2 opposite to R1 for winding the pull member 120. As the spool 150 and the sleeve 160 rotate in unison in the second direction, the ball 164 can be driven to leave the stop region 169A and move continuously along the guide track 169 of the drum 162 without being obstructed. While the spool 150 and the sleeve 160 rotate in unison for winding the pull member 120, the drum 162 and the shaft portion 156 remain stationary.

Referring to FIGS. 4-13, the switch member 136, the first set of gears comprised of the planetary gears 128 and the central gear 130, and the second set of gears comprised of the planetary gears 132 and the central gear 134 are arranged to form a drive transmission that can selectively convert the rotational displacement of the shaft portion 156 and the spool 150 in the first direction R1 (i.e., occurring when the pull member 120 is pulled downward) to a rotational displacement of the actuating part 146 in either of the first direction r1 for raising the bottom part 106 and the second direction r2 for lowering the bottom part 106. In conjunction with FIGS. 4-6, FIGS. 14-17 are various schematic views illustrating the assembly of the aforementioned drive transmission. All of the aforementioned parts of the drive transmission are disposed substantially coaxial with respect to the longitudinal axis X of the transmission axle 114.

Figure 15:
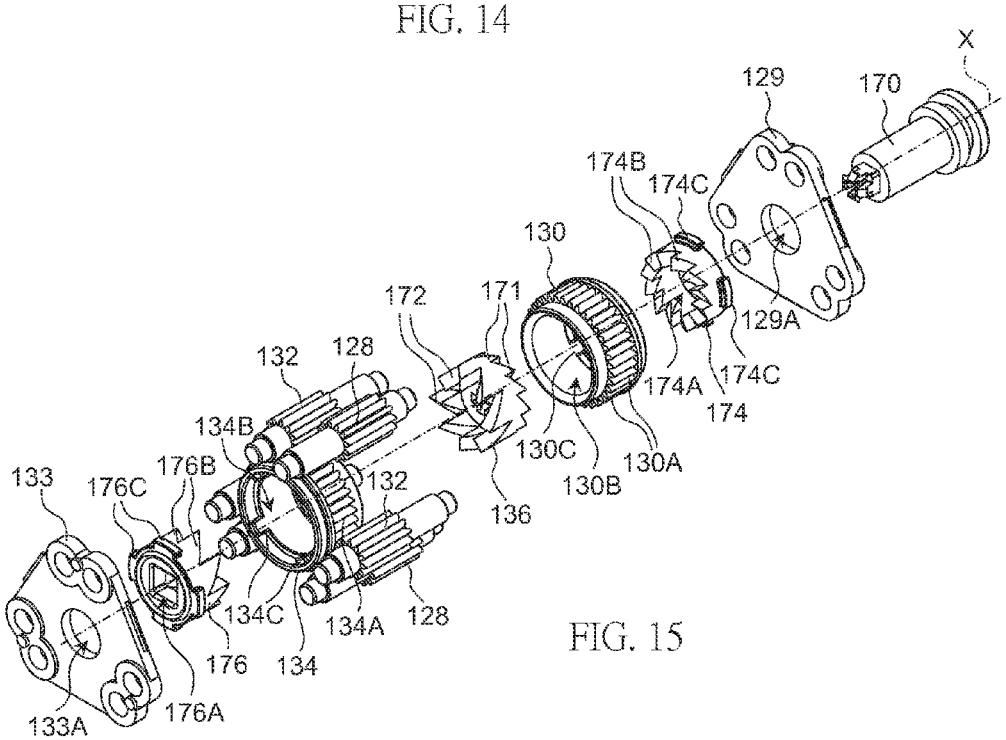
FIG. 15 is an exploded view illustrating the drive transmission provided in the control module shown in FIG. 4.

Referring to FIGS. 5, 6 and 14-16, the switch member 136 can be assembled so as to be rotationally coupled with the shaft portion 156 but movable along the common axis X of the shaft portion 156 and the transmission axle 114. For example, the switch member 136 can be affixed with a sleeve 170 that has an inner cavity having a polygonal shape, and the shaft portion 156 can be fitted into the inner cavity of the sleeve 170. The switch member 136 and the sleeve 170 can thereby axially slide in unison relative to the shaft portion 156, and rotate with the shaft portion 156 in either direction. The switch member 136 can have a plurality of teeth 171 and 172 respectively projecting in two axially opposite directions. The teeth 171 and 172 can be respectively distributed along two circles of substantially equal (as shown in FIG. 15) or different diameters that are centered on the longitudinal axis X.

Figure 16:
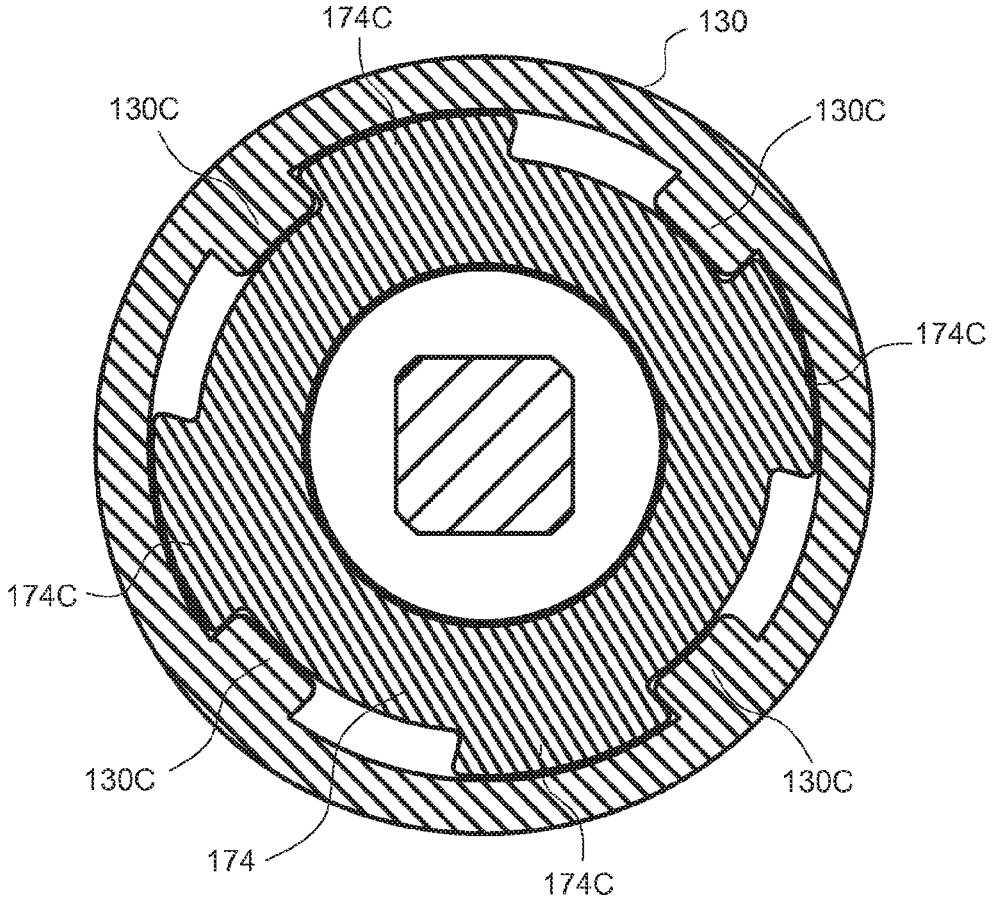
FIG. 16 is a schematic view illustrating the connection of a central gear with a toothed part in the control module shown in FIG. 4.
Figure 17:
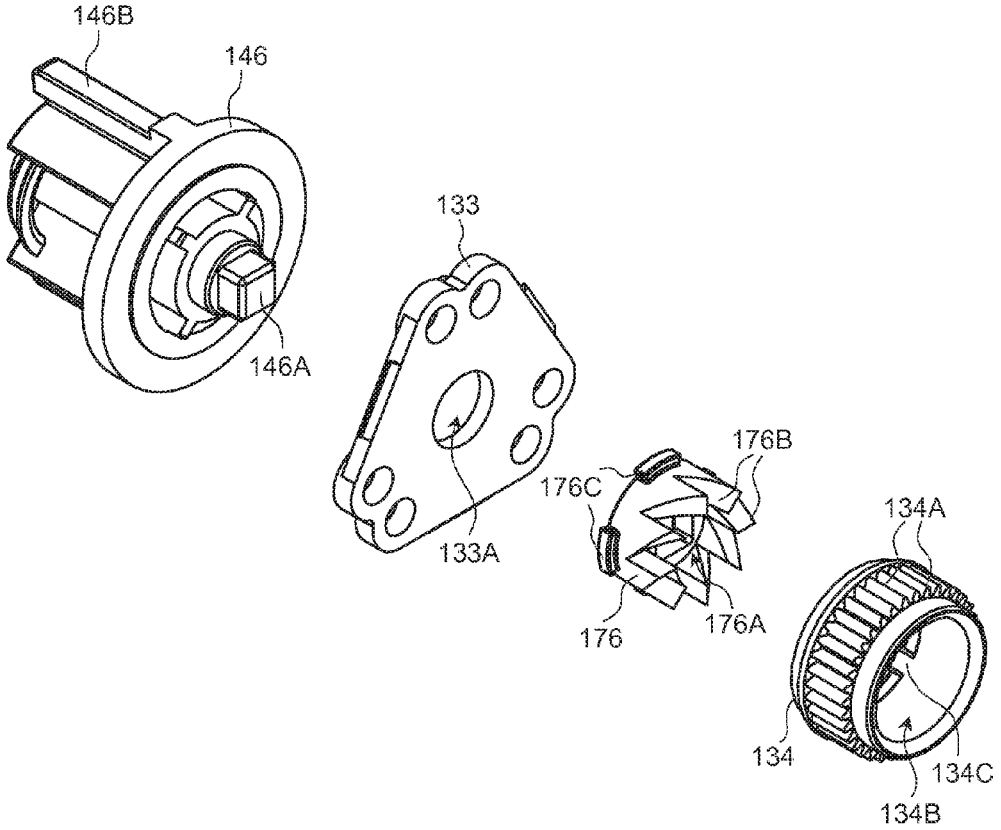
FIG. 17 is a schematic view illustrating a portion of the drive transmission shown in FIG. 15.

The central gear 130 can have a plurality of teeth 130A projecting radially outward, and an inner cavity 130B in which is arranged a toothed part 174. The toothed part 174 can have a central opening 174A, a plurality of teeth 174B, and a plurality of spaced-apart ribs 174C projecting radially outward. The teeth 174B can be distributed around the central opening 174A, and can project axially (i.e., along the longitudinal axis X of the transmission axle 114) at one side of the toothed part 174 toward the switch member 136. The toothed part 174 can be assembled in the inner cavity 130B of the central gear 130, and the central gear 130 can have a plurality of ribs 130C protruding inward that are arranged in respective gaps defined between the ribs 174C of the toothed part 174 (better shown in FIG. 16). As shown in FIG. 16, the gap between each pair of ribs 174C may be larger than the rib 130C received therein, so as to allow a limited rotational displacement of the toothed part 174 relative to the central gear 130. This assembly can rotationally couple the toothed part 174 with the central gear 130 via the contact between each rib 130C of the central gear 130 and the neighboring ribs 174C of the toothed part 174. Moreover, the sleeve 170 can be arranged through the central opening 174A of the toothed part 174 so as to pivotally support the toothed part 174 and the central gear 130. Accordingly, the central gear 130 and the toothed part 174 are pivotally assembled coaxial to the shaft portion 156 and the transmission axle 114, and relative rotation of the central gear 130 and the toothed part 174 with respect to the switch member 136, the sleeve 170 and the shaft portion 156 is allowed.

The planetary gears 128 are arranged around the central gear 130, and respectively mesh with the teeth 130A thereof. The planetary gears 128 can be respectively connected pivotally with the carrier 129, which may be fixedly secured to the casing 140 of the control module 116. The carrier 129 can have a central hole 129A through which the sleeve 170 can be supported for pivotal and axial sliding movements.

Figure 18:
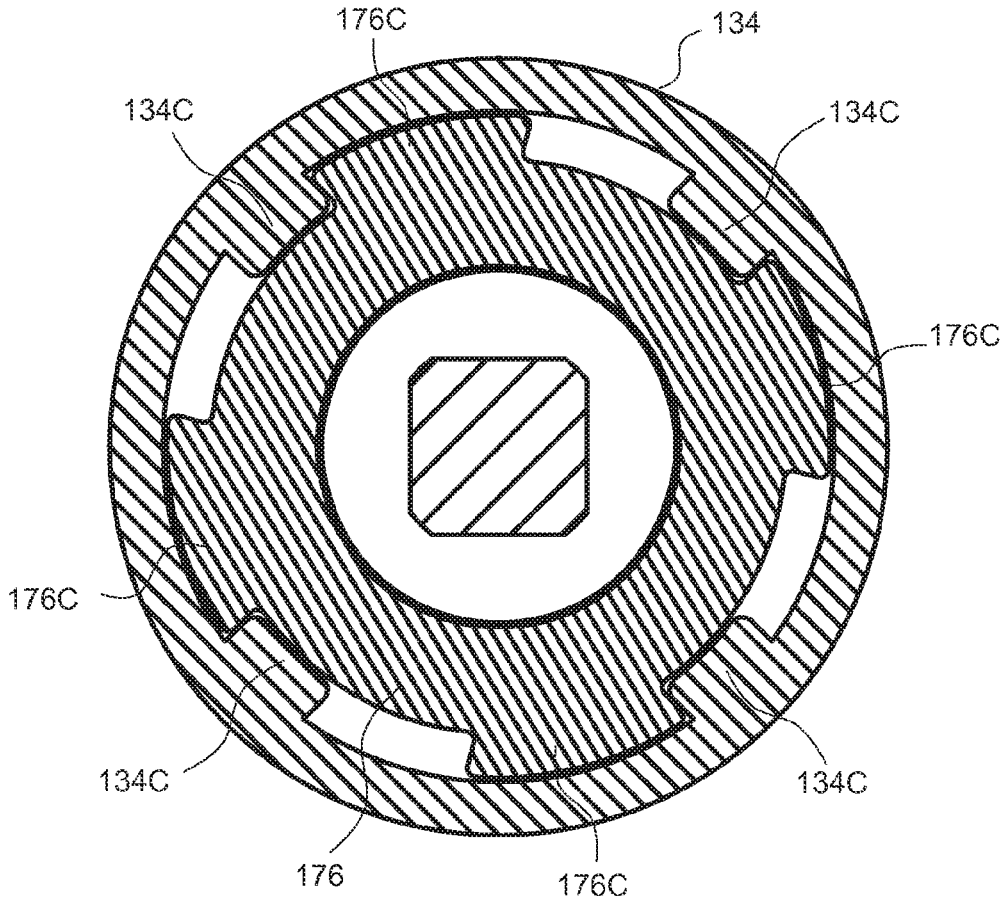
FIG. 18 is a schematic view illustrating the connection of a central gear with a toothed part in the portion of the drive transmission shown in FIG. 17.

Referring to FIGS. 5, 6 and 14-18, the central gear 134 can have a plurality of teeth 134A projecting radially outward, and an inner cavity 134B in which is arranged a toothed part 176. The toothed part 176 can have a central opening 176A, a plurality of teeth 176B, and a plurality of spaced-apart ribs 176C projecting radially outward. The teeth 176B can be distributed around the central opening 176A, and project axially (i.e., along the longitudinal axis X of the transmission axle 114) at one side of the toothed part 176 toward the switch member 136. The toothed part 176 can be assembled in the inner cavity 134B of the central gear 134, and the central gear 134 can further have a plurality of ribs 134C protruding inward that are arranged in respective gaps defined between the ribs 176C of the toothed part 176 (better shown in FIG. 18). As shown in FIG. 18, the gap between each pair of ribs 176C may be larger than the rib 134C received therein, so as to allow a limited rotational displacement of the toothed part 176 relative to the central gear 134. This assembly can rotationally couple the toothed part 176 with the central gear 134 via the respective contact between the ribs 134C of the central gear 134 and the ribs 176C of the toothed part 176. Moreover, the shaft portion 146A of the actuating part 146 can be fitted through the central opening 176A of the toothed part 176 so as to rotationally couple the toothed part 176 and the central gear 134 with the actuating part 146 and the transmission axle 114. Accordingly, the central gear 134 and the toothed part 176 are pivotally assembled coaxial to the shaft portion 156 and the transmission axle 114, and can rotate in unison along with the transmission axle 114 and the actuating part 146 in either direction.

The planetary gears 132 can be respectively connected pivotally with the carrier 133, which may be fixedly secured to the casing 140 of the control module 116 at a position axially spaced apart from the carrier 129. The carrier 133 can have a central hole 133A through which the shaft portion 146A of the actuating portion 146 can be pivotally supported. The planetary gears 132 are arranged around the central gear 134, and respectively mesh with the teeth 134A of the central gear 134 and the planetary gears 128. With this arrangement, the central gears 130 and 134 can concurrently rotate in opposite directions. In one embodiment, the central gears 130 and 134 and the planetary gears 128 and 132 are sized so as to set a same angular speed for the central gears 130 and 134.

In the aforementioned assembly, the switch member 136 can slide along the axis of the shaft portion 156 between two positions: a first position where the teeth 171 of the switch member 136 engage with the teeth 174B of the toothed part 174 and the teeth 172 of the switch member 136 are disengaged from the teeth 176B of the toothed part 176, and a second position where the teeth 172 of the switch member 136 engage with the teeth 176B of the toothed part 176 while the teeth 171 of the switch member 136 are disengaged from the teeth 174B of the toothed part 174. The teeth 171 and 172 of the switch member 136, the teeth 174B of the toothed part 174, and the teeth 176B of the toothed part 176 are respectively shaped so as to transmit rotational displacement of the switch member 136 in only one single direction, i.e., the direction corresponding to a downward pulling action applied on the pull member 120. Accordingly, when the teeth 171 of the switch member 136 are engaged with the teeth 174B of the toothed part 174, the switch member 136 and the central gear 130 can be coupled with each other via the toothed part 174 for rotation in the direction corresponding to a downward pulling action applied on the pull member 120. When the teeth 172 of the switch member 136 are engaged with the teeth 176B of the toothed part 176, the switch member 136 and the central gear 134 can be coupled with each other via the toothed part 176 for rotation in the same direction corresponding to a downward pulling action applied on the pull member 120.

Figure 19:
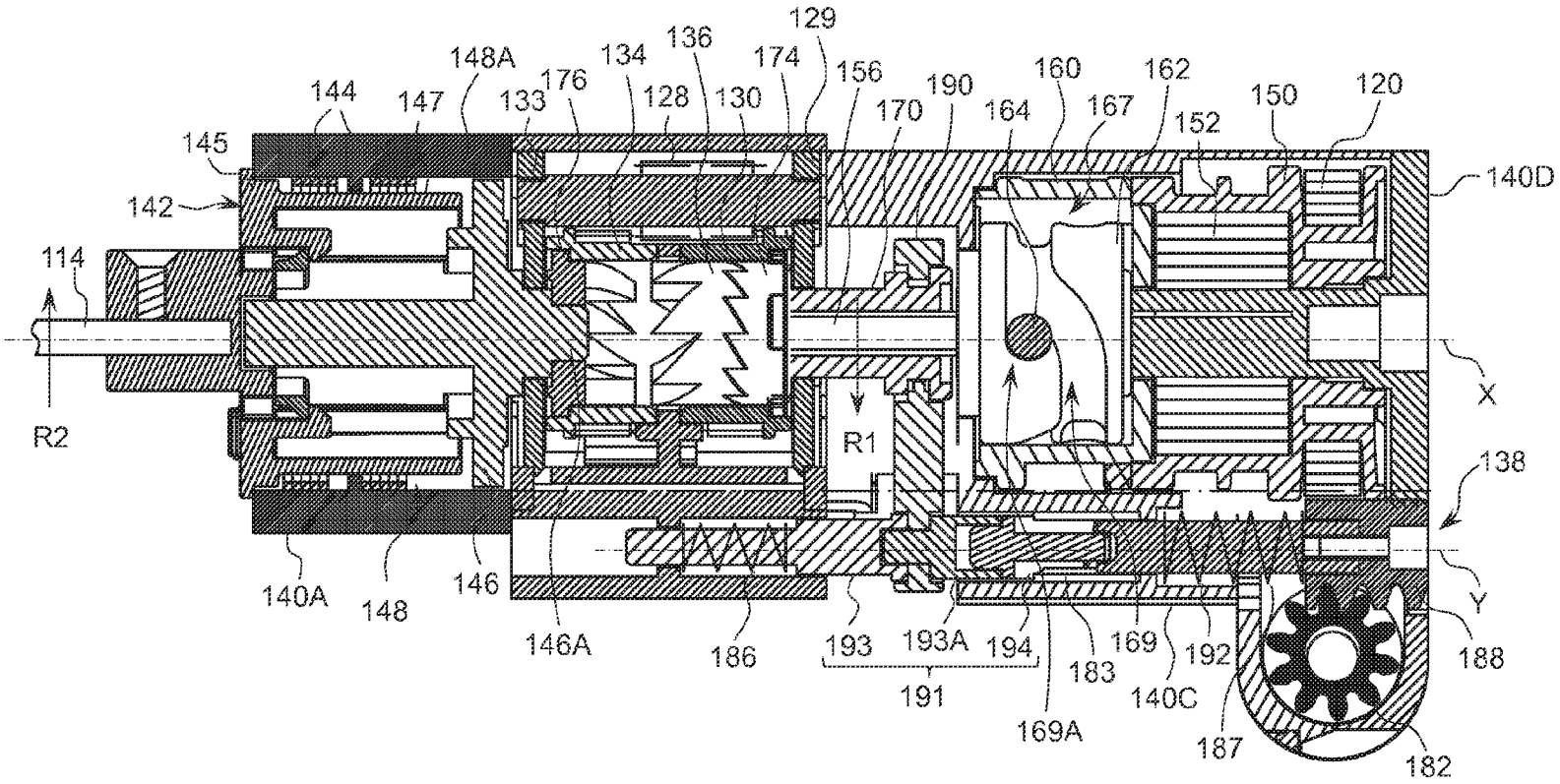
FIG. 19 is a schematic view illustrating the control module in a driving mode of operation by having the switch member coupled with a first central gear.

In conjunction with FIGS. 4-18, FIGS. 19 and 20 are schematic views illustrating exemplary operation of the control module 116. In FIG. 19, the switch member 136 is shown in a first position engaged with the toothed part 174 (i.e., the teeth 171 and 174B are engaged with each other) and disengaged from the toothed part 176. While the control module 116 is in this configuration, the switch member 136, the toothed part 174 and the central gear 130 are coupled together for rotation in the direction R1 corresponding to an unwinding movement of the pull member 120 from the spool 150. Accordingly, the pull member 120 can be pulled downward to cause rotation of the spool 150, the shaft portion 156 and the switch member 136 in the same direction R1. Because the switch member 136 is rotationally coupled with the central gear 130, this rotation of the switch member 136 also drives rotation of the central gear 130 in the same direction R1. Owing to the meshing connection of the planetary gears 128 and 132, the rotation of the central gear 130 in the direction R1 in turn can drive the central gear 134 (and also the toothed part 176, the actuating part 146 and the transmission axle 114 rotationally coupled therewith) to rotate about the longitudinal axis X in the direction R2 opposite to R1. While the planetary gears 128 and 132 rotate to transmit rotation between the central gears 130 and 134, the carriers 129 and 133 remain stationary.

The coupling of the switch member 136 with the central gear 130 can exemplary set the lower or downward driving mode of operation, i.e., the pull member 120 is pulled downward to drive rotation of toothed part 176, the central gear 134, the actuating part 146 and the transmission axle 114 in the aforementioned direction R2 to cause unwinding of the suspension members 112 from the winding units 110 for lowering the bottom part 106. As shown in FIG. 9, the rib 146B of the actuating part 146 rotating in the direction R2 can accordingly push against the prong 144A to contract each spring 144 and urge rotation of the spring 144 in the same direction. As the contracted springs 144 rotate with the actuating part 146, the prongs 144A of the springs 144 can in turn push against the flange surface 147A of the collar 142, which causes rotation of the collar 142 and the transmission axle 114 to lower the bottom part 106.

Figure 20:
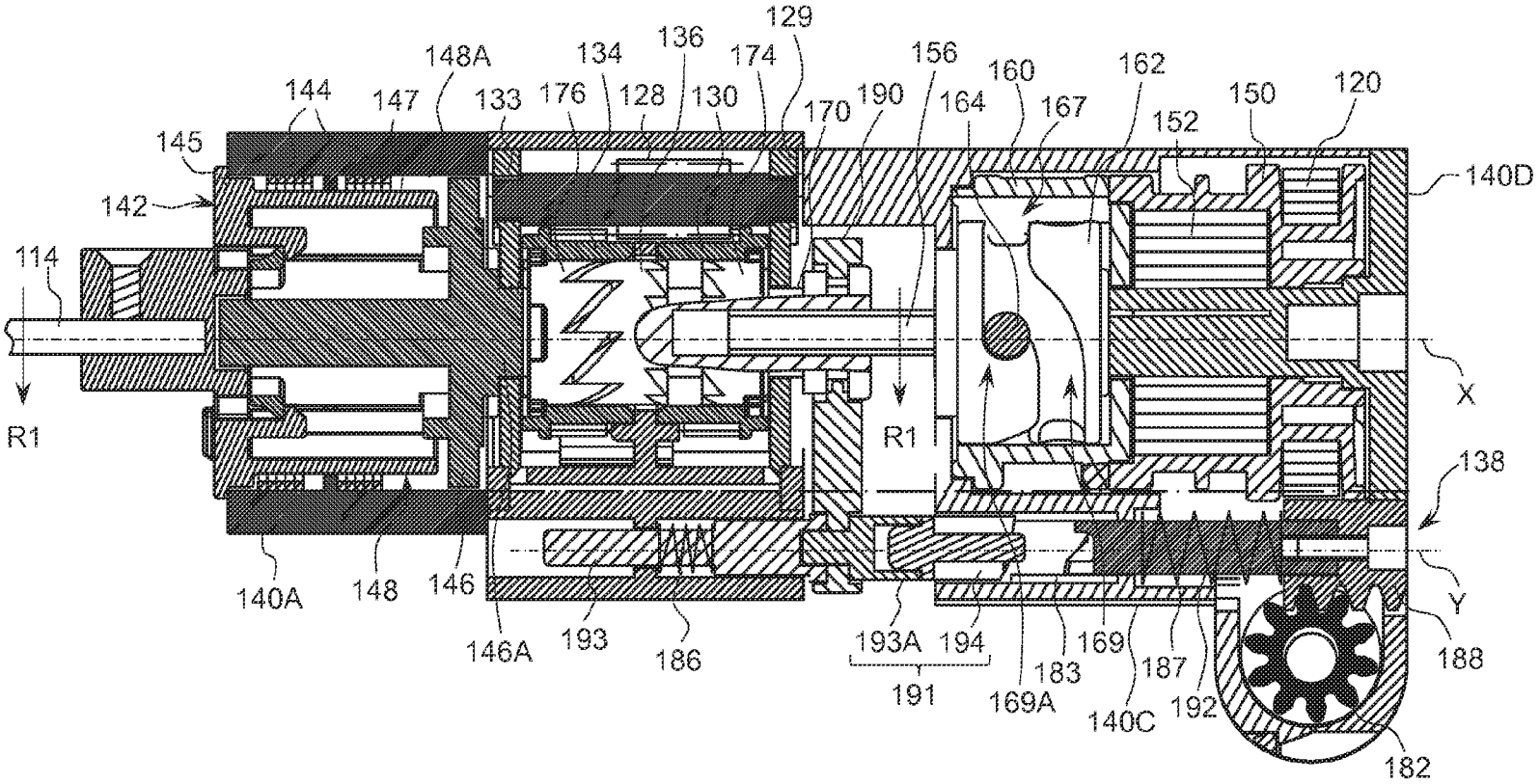
FIG. 20 is a schematic view illustrating the control module in a second driving mode of operation by having the switch member coupled with a second central gear.

In FIG. 20, the switch member 136 is shown in a second position engaged with the toothed part 176 (i.e., the teeth 172 and 176B are engaged with each other) and disengaged from the toothed part 174. While the control module 116 is in this configuration, the switch member 136, the toothed part 176 and the central gear 134 are coupled together for rotation in the direction R1 corresponding to an unwinding movement of the pull member 120 from the spool 150. Accordingly, the pull member 120 can be pulled downward to drive the spool 150, the shaft portion 156, the switch member 136, the toothed part 176 and the central gear 134 to rotate in unison about the longitudinal axis X in the same direction R1. As it is rotationally coupled with the central gear 134, the actuating part 146 also rotates in the same direction R1. Owing to the meshing connection of the planetary gears 128 and 132, the central gear 130 can rotate around the sleeve 170 in an opposite direction while the central gear 134 rotates in the direction R1.

The coupling of the switch member 136 with the central gear 134 can exemplary set the raise or upward driving mode of operation, i.e., the pull member 120 is pulled downward to drive rotation of the toothed part 176, the central gear 134, the actuating part 146 and the transmission axle 114 in the aforementioned direction R1 to cause winding of the suspension members 112 from the winding units 110 for raising the bottom part 106. As shown in FIG. 8, the rib 146B of the actuating part 146 rotating in the direction R1 can push against the prong 144B to contract each spring 144 and urge rotation of the spring 144 in the same direction. As the contracted springs 144 rotate with the actuating part 146, the prongs 144B of the springs 144 can in turn push against the flange surface 147B of the collar 142, which causes rotation of the collar 142 and the transmission axle 114 to raise the bottom part 106.

Owing to the configuration of the central gears 130 and 134, for a given extension of the pull member 120, the number of revolutions performed by each winding unit 110 can be substantially equal to the number of revolutions performed by the spool 150 in both the lower and raise driving modes of operation. In other words, for a same extension of the pull member 120, the resulting vertical course of the bottom part 106 is substantially similar in both the lower and raise driving modes.

Referring to FIGS. 7-9 and 13, when the pull member 120 is released after it is extended downward (e.g., in the upward or downward driving mode), the spring 152 can urge the spool 150 to rotate for winding the pull member 120 (i.e., corresponding to the direction R2 shown in FIG. 19), whereas the drum 162, the shaft portion 156 and the switch member 136 remain stationary. During winding of the pull member 120, the central gears 130 and 134 and the toothed parts 174 and 176 also remain stationary. While the spool 150 is winding the pull member 120 and the shaft portion 156 remains stationary, the suspended weight of the bottom part 106 can bias the transmission axle 114 in a direction that causes either of the two flange surfaces 147A and 147B of the collar 142 to push against the corresponding prongs 144A or 144B for enlarging the springs 144. The enlarged springs 144 can thereby frictionally contact with the inner sidewall 148A of the cavity 148 to prevent rotation of the transmission axle 114 in the direction for lowering the bottom part 106.

Referring again to FIGS. 4-6, the switch member 136 can be operatively connected with the rod assembly 118 via the switch actuating mechanism 138. For selectively coupling the switch member 136 with either of the two central gears 130 and 134, the rod assembly 118 can be manually rotated to actuate the switch actuating mechanism 138, which in turn can displace the switch member 136 between the two functional positions respectively engaged with the toothed parts 174 and 176 (as shown in FIGS. 19 and 20).

The rod assembly 118 can include a wand 180 and a joint part 181. As better shown in FIGS. 1, 3 and 5, the wand 180 can have an elongated shape extending substantially vertical at a front of the window shade 100. The joint part 181 can be pivotally assembled with the casing 140 near an end of the head rail 102, and can have a gear 182. The wand 180 can have an upper end that is pivotally connected with the joint part 181, such that the wand 180 can be tilted relative to a vertical direction to facilitate grasping and manual operation.

Figure 21:
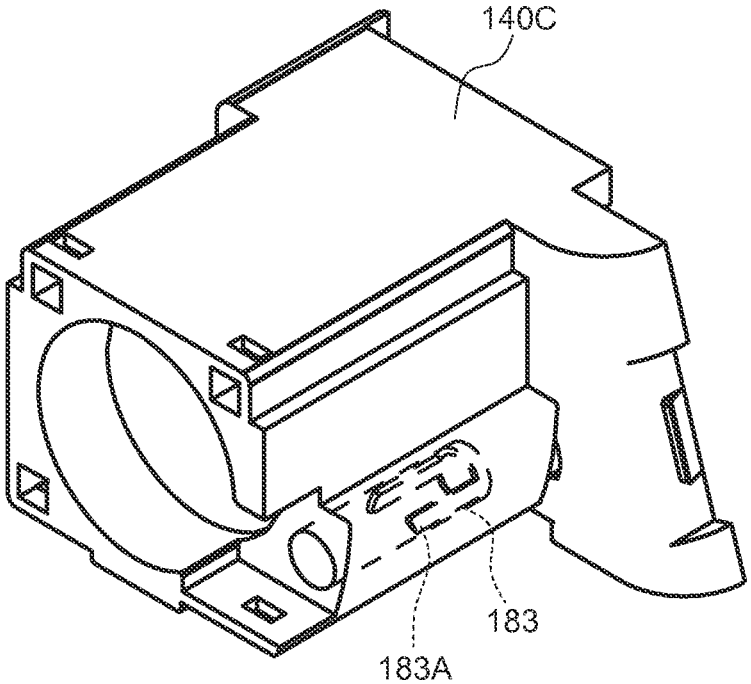
FIG. 21 is a schematic view illustrating a housing portion where is arranged a switch actuating mechanism of the actuating system of the window shade.
Figure 22:
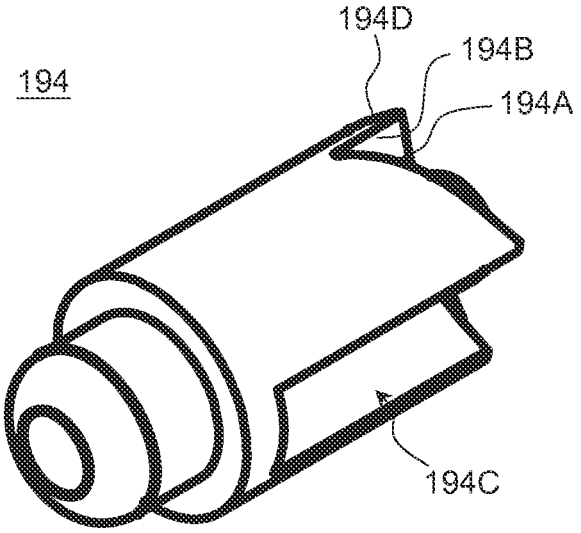
FIG. 22 is a schematic view illustrating a pivotal part of the switch actuating mechanism.
Figure 23:
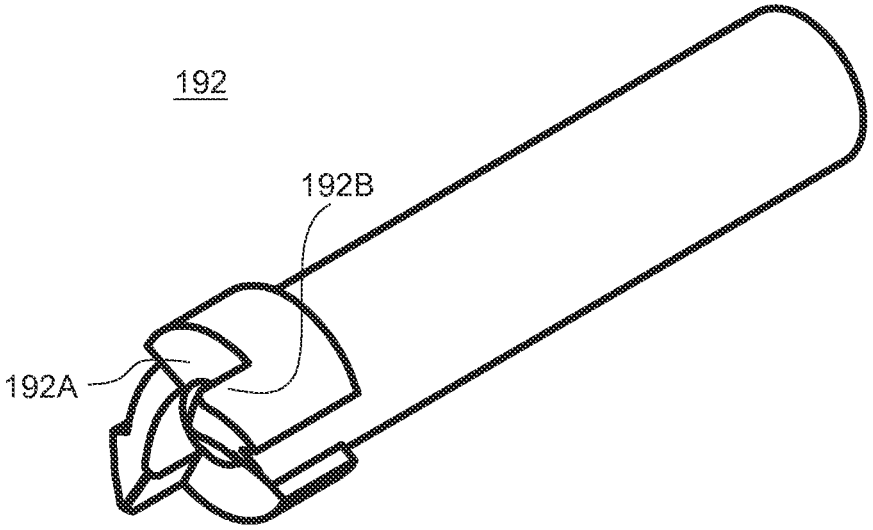
FIG. 23 is a schematic view illustrating a kicking member of the switch actuating mechanism.

In conjunction with FIGS. 5 and 6, FIG. 21 is a schematic view illustrating the housing portion 140C where is arranged the switch actuating mechanism 138. Referring to FIGS. 5, 6 and 21, the switch actuating mechanism 138 can be arranged through an inner cavity of the housing portion 140C of the casing 140 that has an inner sidewall provided with a protruding abutment 183. The switch actuating mechanism 138 can include an arm assembly 184, and two springs 186 and 187. The arm assembly 184 extends generally parallel to the longitudinal axis X of the transmission axle 114, and includes a toothed part 188 that is meshed with the gear 182 of the rod assembly 118. The arm assembly 184 can be driven in movement along a displacement axis Y parallel to the transmission axle 114 by rotating the rod assembly 118, which can displace the switch member 136 for selectively engagement with the toothed part 174 or 176.

In one embodiment, the arm assembly 184 can further include a bracket 190, a shaft assembly 191 and a kicking member 192. The bracket 190 can extend approximately perpendicular to the displacement axis Y and pivotally connect with the sleeve 170. Moreover, the bracket 190 and the shaft assembly 191 can slide in unison along the displacement axis Y to switch the position of the switch member 136.

Referring to FIGS. 5, 6 and 21, the shaft assembly 191 can include a rod segment 193 having an end pivotally connected with a pivotal part 194. The rod segment 193 can be affixed with the bracket 190 that pivotally supports the sleeve 170 and the switch member 136. An end plug 193A may be assembled through the bracket 190 and fixedly connected with the end of the rod segment 193 to affix the bracket 190 with the rod segment 193. The pivotal part 194 can slide with the rod segment 193 along the displacement axis Y, and can also rotate about the displacement axis Y relative to the rod segment 193. In conjunction with FIGS. 5, 6 and 21, FIG. 22 is a schematic view illustrating the pivotal part 194. The pivotal part 194 can have two sets of similar structural features disposed around the displacement axis Y, each set of the structural features including a first ramp surface 194A, an engaging edge 194B, a slot 194C and a second ramp surface 194D. The ramp surface 194A can have a first end adjacent to the engaging edge 194B, and a second end adjacent to the slot 194C. The slot 194C can have an elongated shape extending parallel to the displacement axis Y. The ramp surface 194D can be have two opposite ends respectively connected with the engaging edge 194B and the second slot 194C of the other set of structural features.

The shaft assembly 191 can be movable along the displacement axis Y between a first position where the engaging edge 194B of the pivotal part 194 is disengaged from the end 183A of the abutment 183, and a second position where the engaging edge 194B of the pivotal part 194 rests in contact against an end 183A of the abutment 183.

In conjunction with FIGS. 5, 6 and 21, FIG. 23 is a schematic view illustrating the kicking member 192. The kicking member 192 can be assembled adjacent to the pivotal part 194. The kicking member 192 can have one end affixed with the toothed part 188. Another end of the kicking member 192 opposite to that of the toothed part 188 can be provided with two sets of similar structural features disposed around the displacement axis Y, each set including a ramp surface 192A and a stop edge 192B arranged at one end of the ramp surface 192A. The kicking member 192 can move along the displacement axis Y to bring the pivotal part 194 into resting contact against the end 183A of the abutment 183, or to push the pivotal part 194 for disengagement from the end 183A of the abutment 183.

The two springs 186 and 187 can be respectively connected with the shaft assembly 191 and the kicking member 192, and can respectively bias the shaft assembly 191 and the kicking member 192 toward each other.

Figure 24A:
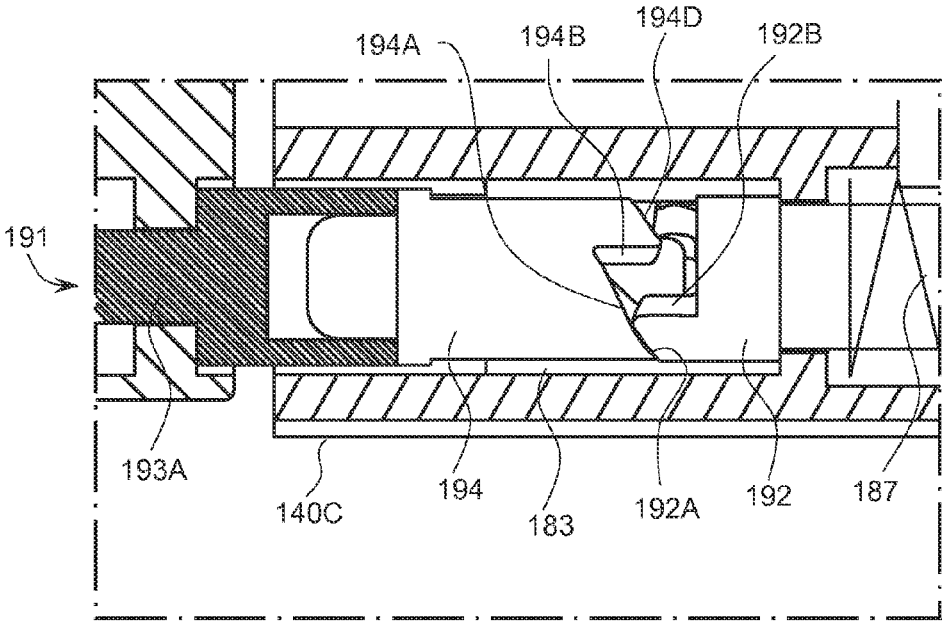
FIGS. 24A and 24B are schematic views illustrating the switch actuating mechanism in a configuration where the switch member is coupled with the first central gear as shown in FIG. 19.
Figure 24B:
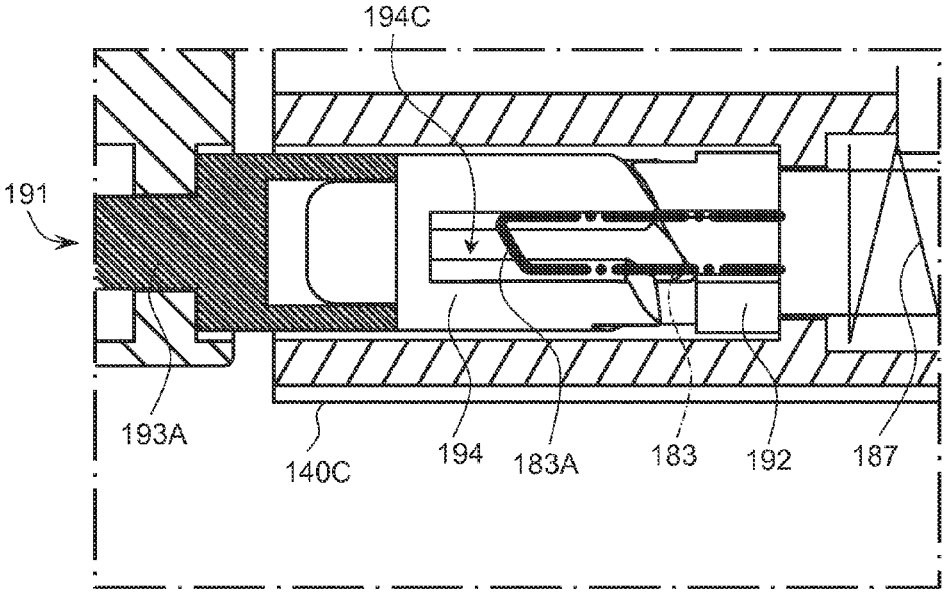

In conjunction with FIGS. 19 and 20, FIGS. 24A-29C are schematic views illustrating exemplary operation of the switch actuating mechanism 138. Referring to FIGS. 19, 24A and 24B, the switch actuating mechanism 138 is shown in a configuration where the switch member 136 is engaged with the toothed part 174 and coupled with the central gear 130. In this configuration, the shaft assembly 191 is in the first position where the engaging edge 194B of the pivotal part 194 is disengaged from the end 183A of the abutment 183, and the abutment 183 is received in the slot 194C of the pivotal part 194. FIGS. 24A and 24B are schematic views representing the shaft assembly 191 and the kicking member 192 in this configuration under two different angles of view.

Figure 25A:
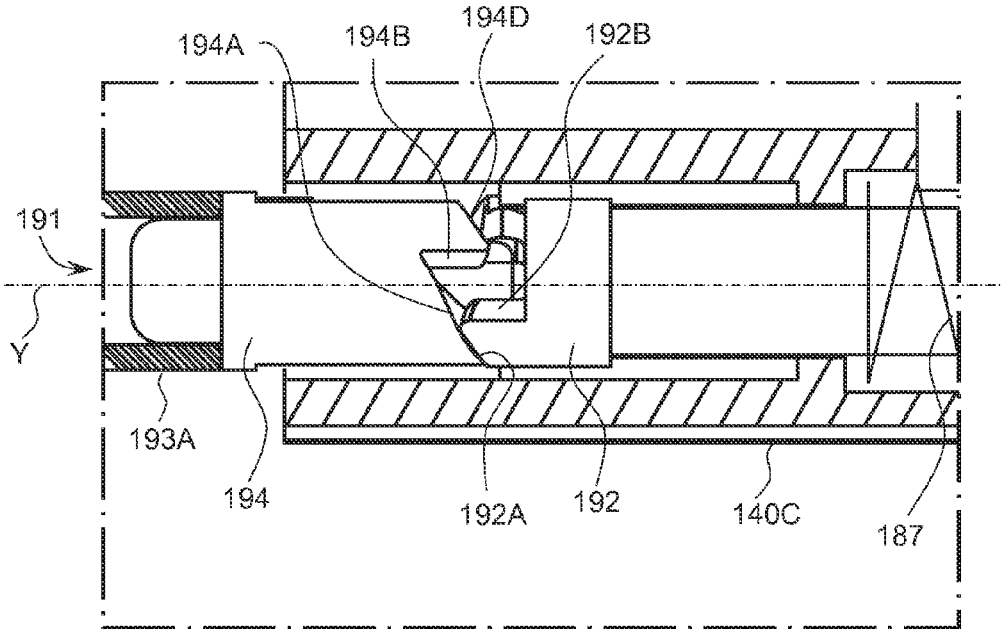
FIGS. 25A-27B are schematic views illustrating exemplary operation of the switch actuating mechanism for moving the switch member from a position coupled with the first central gear to another position coupled with the second central gear as shown in FIG. 20.
Figure 25B:
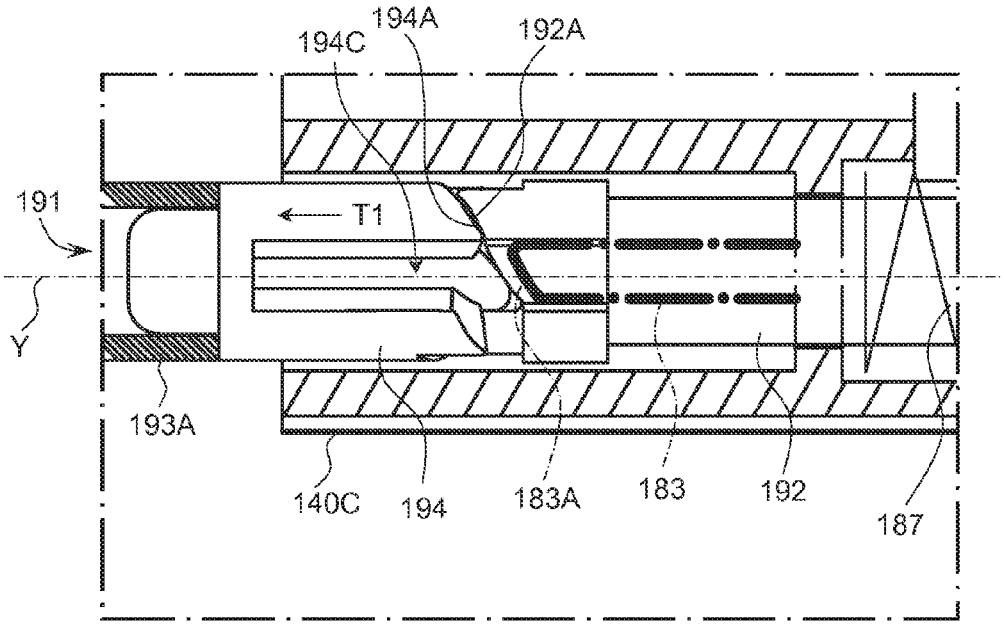

Referring to FIGS. 3, 20 and 25A-27B, for engaging the switch member 136 with the toothed part 176, the rod assembly 118 can be rotated in a direction S, which causes the joint part 181 to rotate and push the kicking member 192 to slide along the displacement axis Y in a direction T1 owing to the meshing engagement between the gear 182 and the toothed part 188. This sliding displacement of the kicking member 192 can compress the spring 187 and cause the ramp surface 192A of the kicking member 192 to contact with the ramp surface 194A of the pivotal part 194, which pushes the shaft assembly 191 to slide along the displacement axis Y in the direction T1 for moving the switch member 136 from the toothed part 174 toward the toothed part 176. This displacement of the shaft assembly 191 also causes the abutment 183 to disengage from the slot 194C of the pivotal part 194 and compress the spring 186. This is shown in FIGS. 25A and 25B, which are two schematic views illustrating a portion of the arm assembly 184 at different angles of views. As long the abutment 183 remains in the slot 194C, rotation of the pivotal part 194 about the displacement axis Y is prevented.

Figure 26A:
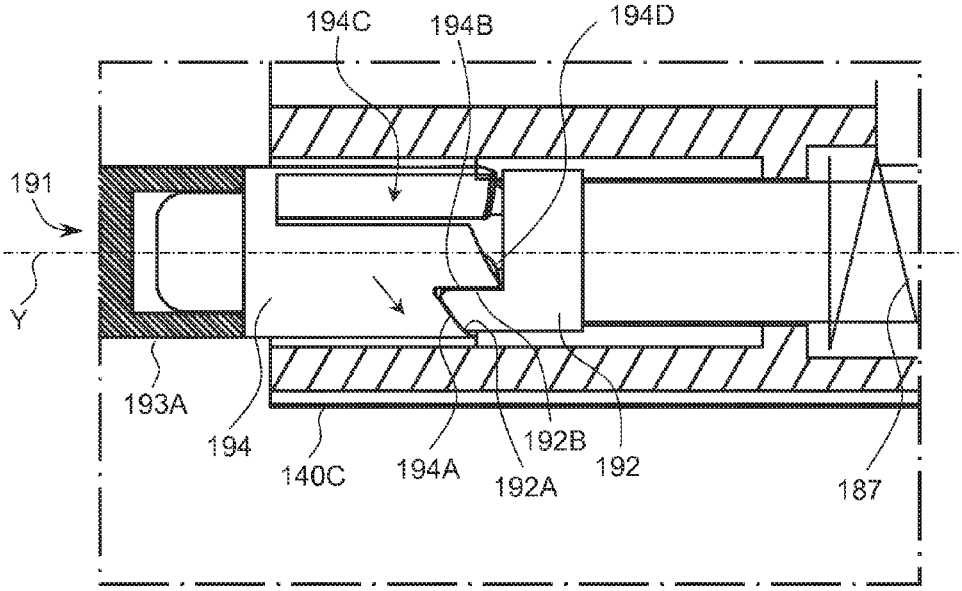
Figure 26B:
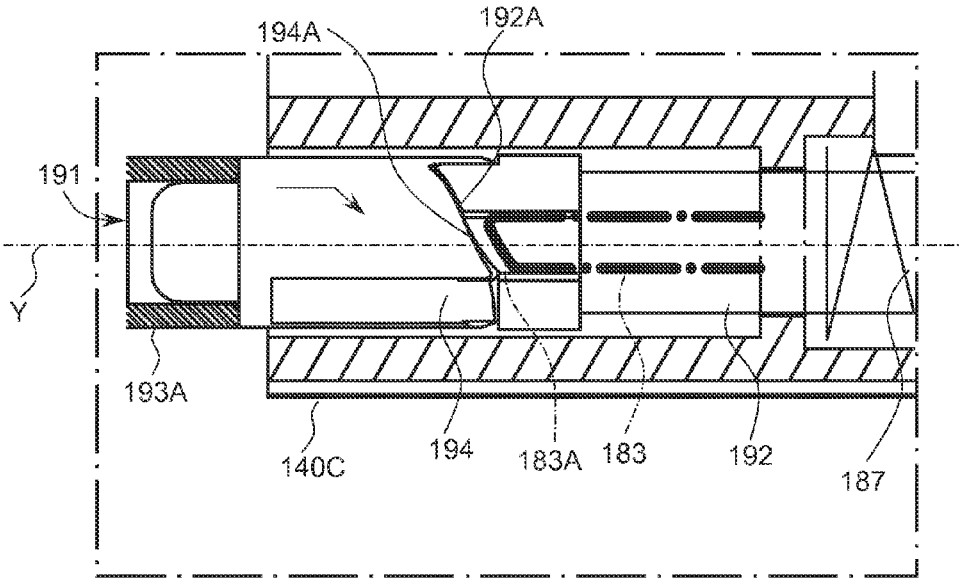

Referring to FIGS. 26A and 26B, once the abutment 183 is disengaged from the slot 194C, the pushing action applied by the kicking member 192 further causes rotation of the pivotal part 194 about the displacement axis Y until one engaging edge 194B contacts with the stop edge 192B of the kicking member 192, and the abutment 183 is misaligned from the slot 194C and faces the first ramp surface 194A.

Figure 27A:
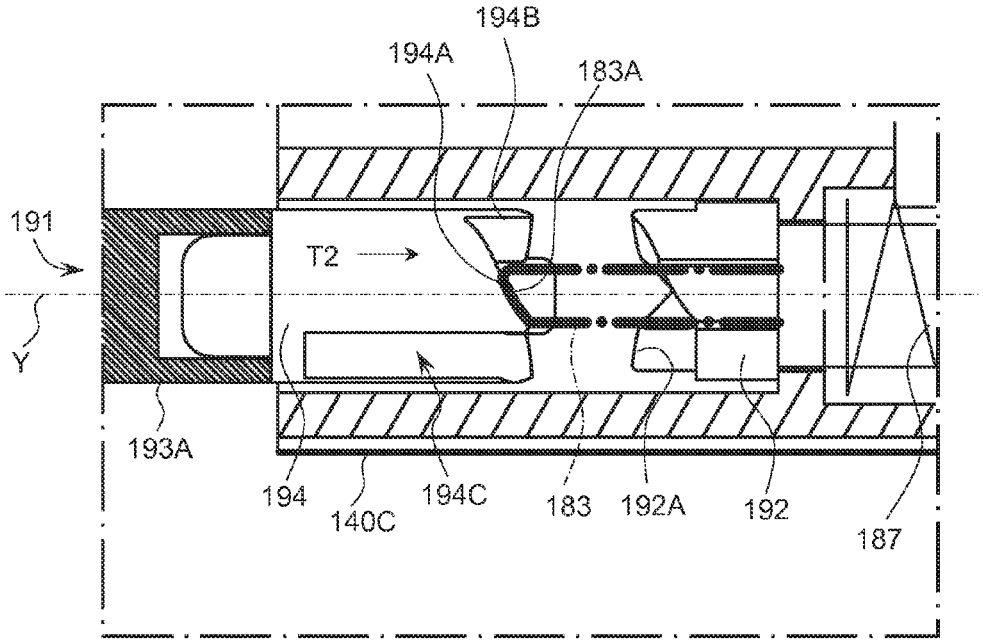
Figure 27B:
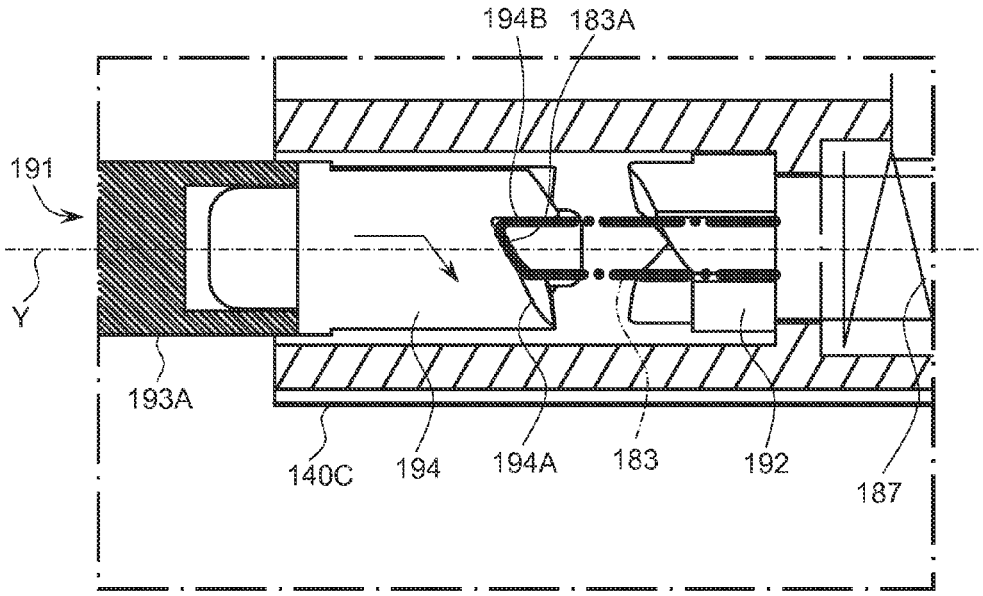

Referring to FIGS. 27A and 27B, the rod assembly 118 then can be released, and the spring 187 can bias the kicking member 192 to slide along the displacement axis Y in a direction T2 opposite to T1 to reversely rotate the rod assembly 118 for recovering its initial position. In the meantime, the spring 186 can bias the shaft assembly 191 in the same direction T2, which urges the ramp surface 194A of the pivotal part 194 to come in sliding contact with the end 183A of the abutment 183. Once the end 183A of the abutment 183 rides the first ramp surface 194A of the pivotal part 194, the pivotal part 194 can rotate about the displacement axis Y until the engaging edge 194B engages with the end 183A, whereas the kicking member 192 can be biased by the spring 187 to move out of contact with the pivotal part 194. The engagement between the end 183A of the abutment 183 and the engaging edge 194B of the pivotal part 194 can keep the shaft assembly 191 in the second position for holding the switch member 136 engaged with the toothed part 176.

Figure 28A:
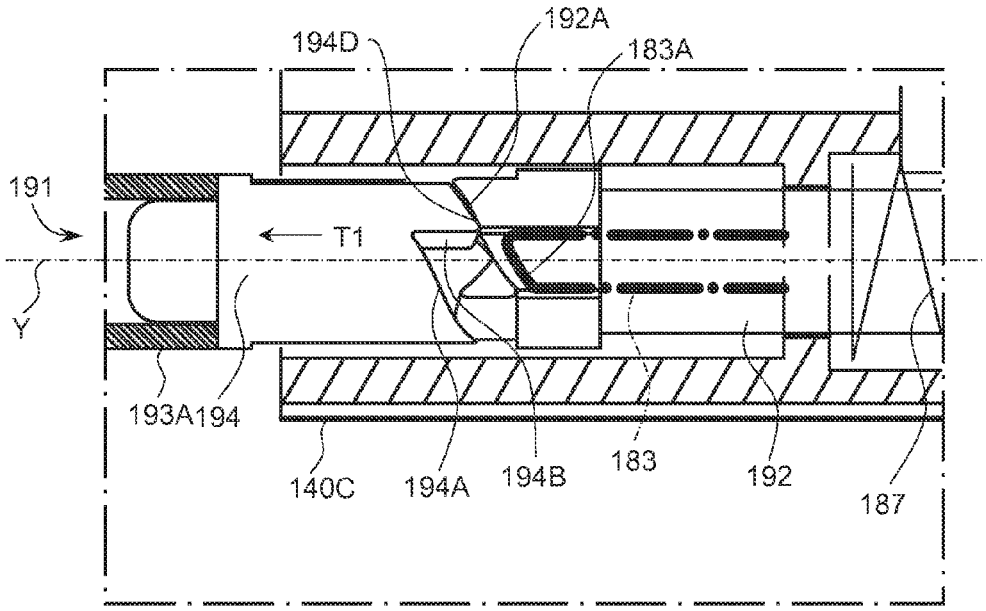
FIGS. 28A-29C are schematic views illustrating exemplary operation of the switch actuating mechanism for moving the switch member from the position coupled with the second central gear back to the position coupled with the first central gear.

In conjunction with FIGS. 3, 5, 19 and 20, FIGS. 28A-29C are schematic views illustrating exemplary operation of the switch actuating mechanism 138 to displace the switch member 136 from the position engaged with the toothed part 176 to the position engaged with the toothed part 174. Referring to FIGS. 3, 5 and 28A, for engaging the switch member 136 with the toothed part 174, the rod assembly 118 can be rotated in the same direction S, which causes the joint part 181 to rotate and push the kicking member 192 to slide along the displacement axis Y in the direction T1. This sliding displacement of the kicking member 192 can compress the spring 187 and cause the ramp surface 192A of the kicking member 192 to contact with the second ramp surface 194D of the pivotal part 194, which pushes the shaft assembly 191 to slide along the displacement axis Y in the direction T1 for disengaging the pivotal part 194 from the end 183A of the abutment 183. This displacement of the shaft assembly 191 may also cause a slight movement of the switch member 136 toward the toothed part 176.

Figure 28B:
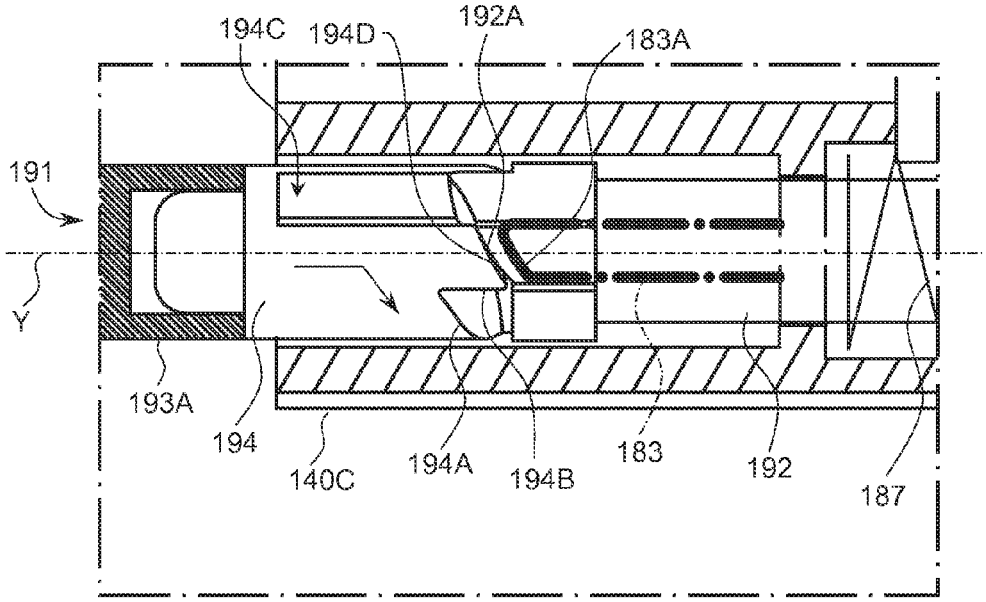

Referring to FIG. 28B, once the pivotal part 194 disengages from the end 183A of the abutment 183, the sliding contact between the second ramp surface 194D and the ramp surface 192A of the kicking member 192 causes rotation of the pivotal part 194 until the end 183A of the abutment 183 faces the second ramp surface 194D.

Figure 29A:
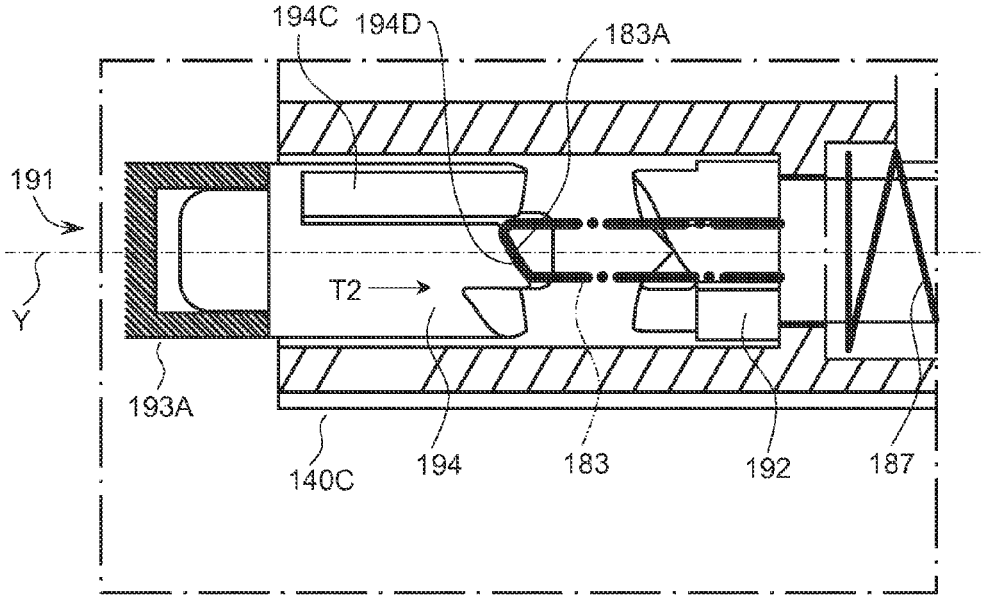

Referring to FIG. 29A, the rod assembly 118 then can be released, and the spring 187 can bias the kicking member 192 to slide along the displacement axis Y in a direction T2 opposite to T1 to reversely rotate the rod assembly 118 for recovering its initial position. In the meantime, the spring 186 can bias the shaft assembly 191 in the same direction T2, which urges the second ramp surface 194D of the pivotal part 194 to come in sliding contact with the end 183A of the abutment 183.

Figure 29B:
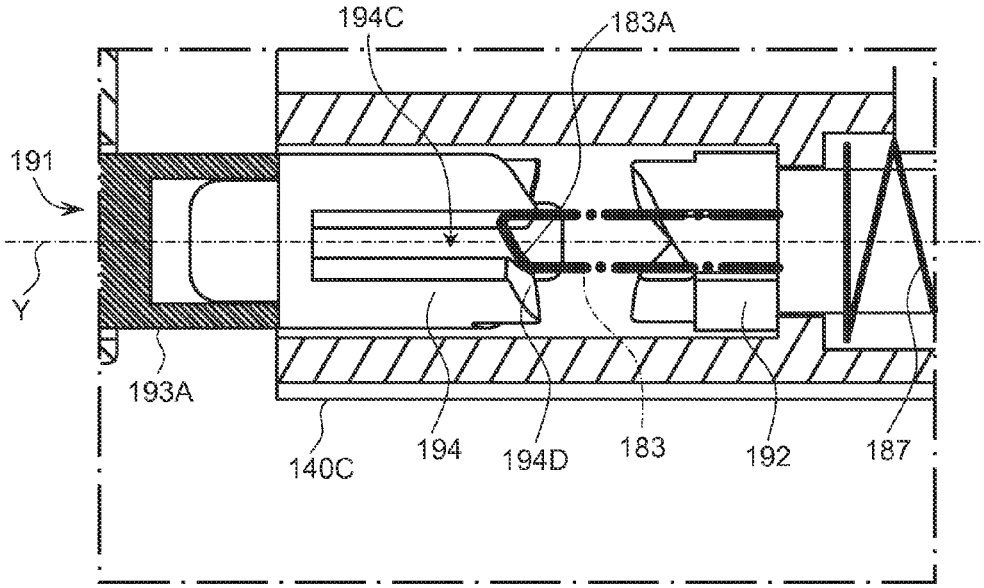

Referring to FIG. 29B, once the end 183A of the abutment 183 rides the second ramp surface 194D of the pivotal part 194, the pivotal part 194 can rotate about the displacement axis Y until the abutment 183 can engage with one slot 194C of the pivotal part 194, whereas the kicking member 192 can be biased by the spring 187 to move out of contact with the pivotal part 194.

Figure 29C:
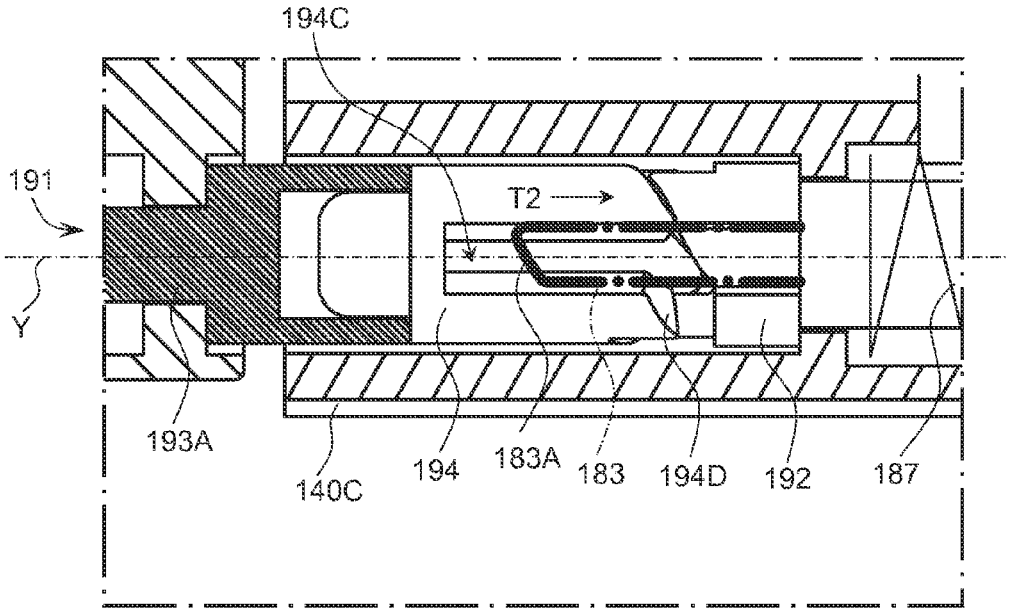

Referring to FIG. 29C, the biasing action applied by the spring 186 can then urge the shaft assembly 191 in the direction T2 to move the switch member 136 into engagement with the toothed part 174 and disengage the ramp surfaces 194A, 194D and engaging edges 194B of the pivotal part 194 from the end 183A of the abutment 183. During this displacement, the abutment 183 is slidably received in the slot 194C of the pivotal part 194.

With the aforementioned switch actuating mechanism 138, the rod assembly 118 can thus be rotated in the same direction to selectively couple the switch member 136 with any of the central gears 130 and 134 for switching the actuating system 108 between the lower and raise driving mode of operation.

It will be appreciated that the actuating systems described herein may be suitable for any types of vertical window shades. Examples of window shades that can use the actuating systems include, without limitation, window shades having a honeycomb structure, window shades having a plurality of slats that are suspended between a head rail and a bottom part, or window shades including a plurality of curved vanes suspended between a head rail and a bottom part.

The structures described herein use an actuating system that can selectively switch between a lower and a raise mode of operation by rotating a rod assembly, and use a downward displacement of a pull member to lower and raise the window shade depending on whether its switching state. The actuating systems are simple to operate, allow convenient adjustment of the window shade, and are safe as the pull member has a limited length of extension.

Realizations of the structures and methods have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. An actuating system for a window shade, comprising:

a transmission axle rotatable to collapse and expand a window shade;

a driving unit including a shaft portion and a pull member, the pull member being operable to drive rotation of the shaft portion in a first direction;

a first central gear, and a plurality of first planetary gears respectively meshed with the first central gear;

a second central gear rotationally coupled with the transmission axle, and a plurality of second planetary gears respectively meshed with the second central gear and the first planetary gears; and a switch member rotationally coupled with the shaft portion, the switch member being further movable along an axis of the shaft portion between a first position where the switch member and the first central gear are coupled with each other for rotation in the first direction, and a second position where the switch member and the second central gear are coupled with each other for rotation in the first direction;

wherein a rotation of the shaft portion in the first direction drives rotation of the transmission axle in a second direction opposite to the first direction when the switch member is in the first position, and drives rotation of the transmission axle in the first direction when the switch member is in the second position.

2. The actuating system according to claim 1, wherein the first and second planetary gears are pivotally supported by fixed carriers.

3. The actuating system according to claim 1, wherein the shaft portion is arranged coaxial to the transmission axle.

4. The actuating system according to claim 1, wherein the first and second central gears are respectively arranged coaxial to the shaft portion.

5. The actuating system according to claim 1, wherein at least one of the first and second central gear has an inner cavity in which is rotationally coupled a toothed part, the toothed part being engageable with the switch member.

6. The actuating system according to claim 5, wherein the toothed part includes a plurality of teeth protruding along an axis of the transmission axle.

7. The actuating system according to claim 1, wherein the first and second central gears are respectively coupled rotationally with a first and a second toothed part, the first and second toothed parts being arranged in respective inner cavities of the first and second central gears, the switch member in the first position being engaged with the first toothed part, and the switch member in the second position being engaged with the second toothed part.

8. The actuating system according to claim 7, wherein the switch member has a plurality of first and second teeth that project in two axially opposite directions, the first teeth being engaged with the first toothed part when the switch member is in the first position, and the second teeth being engaged with the second toothed part when the switch member is in the second position.

9. The actuating system according to claim 8, wherein the first and second toothed parts, and the first and second teeth are configured to transmit rotation of the switch member to the first or second central gear in only the first direction.

10. The actuating system according to claim 7, wherein the first and second toothed parts are arranged coaxial to the transmission axle.

11. The actuating system according to claim 1, wherein the driving unit further includes a spool connected with the pull member, the spool rotating in the second direction to wind the pull member and in the first direction to unwind the pull member.

12. The actuating system according to claim 11, wherein the switch member and the spool are rotatable in unison in the first direction, and the switch member remains stationary while the spool rotates in the second direction for winding the pull member.

13. The actuating system according to claim 1, wherein the pull member is a cord, the pull member being pulled downward to drive rotation of the switch member in the first direction.

14. The actuating system according to claim 1, further including a casing having a cavity, and a spring arranged in the cavity and having two spaced-apart prongs, the transmission axle having a first and a second flange surface, the first flange surface being able to push against a first one of the two prongs for enlarging the spring, the enlarged spring being in frictional engagement with an inner sidewall of the cavity to prevent rotation of the transmission axle.

15. The actuating system according to claim 14, wherein the second central gear is further rotationally coupled with an actuating part, the actuating part pushing against either of the two prongs for contracting the spring when the second central gear rotates in the first or second direction, the contracted spring thereby loosening the frictional engagement with the inner sidewall to allow rotation of the transmission axle.

16. The actuating system according to claim 15, wherein the transmission axle is attached to a collar on which are provided the first and second flange surfaces, the two prongs of the spring are positioned in a gap between the first and second flange surface, and the actuating part has a rib received in a space between the two prongs.

17. The actuating system according to claim 15, wherein the actuating part has a rib received in a space between the two prongs of the spring, and the first and second flange surfaces of the transmission axle are arranged outside the space.

18. The actuating system according to claim 17, wherein a rotation of the actuating part in the first direction causes the rib to push one of the two prongs in contact against one of the first and second flange surfaces for driving rotation of the transmission axle in the first direction, and a rotation of the actuating part in the second direction causes the rib to push the other one of the two prongs in contact against the other one of the first and second flange surfaces for driving rotation of the transmission axle in the second direction.

19. The actuating system according to claim 1, wherein the second central gear and the transmission axle rotate in the second direction to lower a window shade, and in the first direction to raise the window shade.

20. The actuating system according to claim 1, further including a rod assembly that extends substantially vertical and is connected with the switch member via a switch actuating mechanism, the rod assembly being rotatable to drive displacement of the switch member along an axis of the transmission axle for selectively coupling the switch member with either of the first and second central gear.

21. A window shade comprising:

a head rail, a bottom part, and a shading structure arranged vertically between the head rail and the bottom rail;

a winding unit having a suspension member connected with the bottom part; and the actuating system according to claim 1, arranged in the head rail, the winding unit being rotationally coupled with the transmission axle, wherein the transmission axle rotates in the second direction to cause unwinding of the suspension member from the winding unit for lowering the bottom part, and in the first direction to wind the suspension member into the winding unit for raising the bottom part.

* * * * *